US007118850B2

(12) United States Patent
Fujita et al.

(10) Patent No.: US 7,118,850 B2
(45) Date of Patent: Oct. 10, 2006

(54) COLOR DEVELOPER REPLENISHER AND CONCENTRATED COMPOSITION FOR COLOR PHOTOGRAPHIC MATERIAL

(75) Inventors: Yoshihiro Fujita, Kanagawa (JP); Kazuaki Yoshida, Kanagawa (JP)

(73) Assignee: Fuji Photo Film Co., Ltd., Minami-Ashigara (JP)

( * ) Notice: Subject to any disclaimer, the term of this patent is extended or adjusted under 35 U.S.C. 154(b) by 447 days.

(21) Appl. No.: 10/622,534

(22) Filed: Jul. 21, 2003

(65) Prior Publication Data

US 2004/0029055 A1 Feb. 12, 2004

(30) Foreign Application Priority Data

Jul. 22, 2002 (JP) ..... P.2002-212674

(51) Int. Cl.
*G03C 1/413* (2006.01)

(52) U.S. Cl. ..... 430/466; 430/493

(58) Field of Classification Search ..... 430/466, 430/493

See application file for complete search history.

(56) References Cited

U.S. PATENT DOCUMENTS 5,837,435 A * 11/1998 Abe ..... 430/490

FOREIGN PATENT DOCUMENTS

| | | |
|---|---|---|
| JP | 11-194462 | 7/1999 |
| JP | 11-288067 A | 10/1999 |
| JP | 11-288068 A | 10/1999 |

OTHER PUBLICATIONS

Abstract of JP11288067 Oct. 19, 1999.*
Abstract of JP 11288068 Oct. 19, 1999.*

* cited by examiner

*Primary Examiner*—Hoa Van Le
(74) *Attorney, Agent, or Firm*—Buchanan Ingersoll & Rooney PC

(57) ABSTRACT

A concentrated composition of a color developer replenisher for a silver halide color photographic material, the composition comprising a single solution, wherein the solution comprises 0.14 mol/liter or more of a p-phenylenediamine color developing agent, the solution has a specific gravity of 1.2 or more, the solution has pH of 13.3 or more, the solution comprises from 0.2 to 1 mol/liter of at least one compound selected from benzenesulfonic acids which may be substituted with an alkyl group, and lactams, and the solution comprises substantially no alkanolamine.

18 Claims, No Drawings

COLOR DEVELOPER REPLENISHER AND CONCENTRATED COMPOSITION FOR COLOR PHOTOGRAPHIC MATERIAL

FIELD OF THE INVENTION

The present invention relates to a photographic development processing solution and processing composition for a silver halide photographic material (hereinafter sometimes referred to as merely a photographic material), particularly relates to a color developer replenisher and a highly concentrated liquid development processing composition for preparing the color developer replenisher having an aptitude with rapid processing.

BACKGROUND OF THE INVENTION

In recent years, an automatic processor called a mini-lab set up at a shop front for processing photographic materials has prevailed for a quick print service for general users and the rationalization of collection and delivery between a photograph shop and a processing laboratory. The development processing agents for use in mini-labs are in many cases supplied in the form of liquid composition comprising processing chemicals of the component dissolved in advance in a solvent, e.g., water, since this form is advantageous in that a processing solution can be easily prepared at the time of use by mixing and dilution with water. However, the form of liquid composition requires containers for containing the solvent, e.g., water, for dissolving processing components, i.e., processing chemicals, and for the composition, which is disadvantageous in the point of transfer costs. Therefore, liquid composition is generally supplied in the form of a concentrated liquid processing composition (called "concentrated" in place of "condensed" in the industry) to reduce the volume by concentration.

Further, a concentrated liquid processing composition in many cases consists of a plurality of composition units not as the constitution of a single solution from various reasons such as storage stability, degree of concentration and handleability. The composition units constituting a concentrated composition are called parts.

Describing as to color development processing composition, when processing composition is constituted by a plurality of parts, it is advantageous in the point that the stability of the composition is increased and further concentration and volume reduction are contrived, but it is accompanied by disadvantages such that a plurality of concentrated solutions must be mixed not a simple dilution with water in preparing a processing solution, and workload increases in disposing many empty containers of compositions. Accordingly, even if processing composition is composed of single constitution (hereinafter referred to as one-part constitution or one liquid type constitution, which are the same meaning), when storage stability is ensured and the composition is concentrated, facilities for usage are extremely high.

From the above viewpoint, concentrated composition: of one-part constitution for a color developer replenisher has been conventionally developed and introduced to the market in practice, but the concentrated composition of one-part constitution cannot sufficiently cope with the latest trend of needs in the market in the following points, and such is the state of things that concentrated processing composition of the plural part constitution is rather generally used.

As the problems of concentrated composition of one-part constitution for a color developer replenisher, in the first place, although further concentration has been required of the processing composition in recent years for the purpose of a quick print service for general users and for the reduction of discharge of a waste solution, the requirement is not sufficiently met; secondly, a phenomenon of precipitation of the components of a developing replenisher prepared from concentrated processing composition in a replenishing tank which is called creeping over, and the desensitization of a photographic material to be processed are not sufficiently solved; and thirdly, it is necessary to reduce the cost as the processing agent at least to the same with or lower than the cost of the processing agent of the plural part constitution.

With respect to the first problem, it is necessary to highly activate a color developing solution so as to shorten a developing process for a quick print service, it is necessary to reduce replenishing amount for the reduction of discharge of a waste solution, and it is necessary to supply processing chemicals necessary for development reaction by a reduced replenishing amount. At all events, further concentration of a color developer replenisher, i.e., further concentration of concentrated composition for a developer replenisher, becomes necessary.

However, compatibility of thickening and stabilization does not yet reach sufficient level in one liquid type development processing composition such that precipitation is liable to occur due to temperature fluctuation during storage when the concentration of development processing composition is increased. For example, a concentrated developing composition, of one-part constitution having carbonate concentration of from 0.5 to 2 mol/liter, a molar ratio of potassium ion to sodium ion of from 1 to 4, and pH of 12.5 or more is disclosed in JP-A-11-194462 (the term "JP-A" as used herein means an "unexamined published Japanese patent application"). The concentration of a developing agent can be made high by this developing composition, but higher concentration without generating precipitation is difficult, e.g., in a case where a replenishing amount is as low as 45 ml/m$^2$ of a photographic material, or in a case of rapid development where color development processing time is 25 seconds.

Creeping over, which is the second problem, is a phenomenon that the components of a developing solution mainly comprising a developing agent and a fluorescent brightening agent creep up and generate precipitation in a developer replenisher tank, in particular over a part where a liquid is in contact with air on the tank wall, and the upper part of that part, or when a floating lid or a floating ball is used (they are used in general) for preventing oxidation of a replenisher, the upper part of such a floating lid or a floating ball. Further, desensitized development means a phenomenon that when the precipitated crystals crept over peel off, fall into a replenisher tank and are dissolved, the sensitivity of a photographic material processed with that replenisher lowers. A technique of solving these problems concerning concentrated composition of one-part constitution for a color developer replenisher has not yet found.

With respect to the third problem of the cost, e.g., concentrated developing composition of one-part constitution containing 0.06 mol/liter or more of a p-phenylenediamine color developing agent in a state of free base (not forming a salt), having pH of from 7 to 13, and containing a straight chain organic solvent having a molecular weight of from 50 to 200 having a hydroxyl group in the same amount with water or more is disclosed in U.S. Pat. No. 6,017,687. Although this composition is concentrated, an inexpensive salt type developing agent (e.g., sulfate) cannot be used as the color developing agent, or the removal of sulfate is necessary, so that this composition is not practicable in the point of cost.

Accordingly, processing composition for a color developer replenisher having high degree of concentration capable of answering development of further low replenishing rate and/or rapid development required in recent years, free of a creeping phenomenon in a replenisher tank, moreover, practicably low cost, does not yet reach the level of satisfying a strong demand of the market.

SUMMARY OF THE INVENTION

The present invention aims at providing a technique capable of answering the requirements of the reduction of replenishment, further rapidity, and the reduction of a cost in the color-lab market. Specifically, a first object of the invention is to provide concentrated composition of one-part constitution for a color developer replenisher having stability not generating precipitation even when preserved under low temperature, having a high degree of concentration capable of rapid development and low replenishing development, and practicable in cost.

A second object of the invention is to provide a color developer replenisher not accompanied by a phenomenon of creeping up (crystallization and desensitization).

A third object of the invention is to provide a rapid processing system of combining a color developer replenisher prepared from concentrated composition of one-part constitution, a color photographic material having a rapid processing aptitude, and a printer processor of a sheet transfer method.

The above objects of the present invention have been achieved by the following constitutions of the invention.

1. A concentrated composition of a color developer replenisher for a silver halide color photographic material which comprises a single (one-part) solution satisfying the following essential requisites for the composition:
(1) containing 0.14 mol/liter or more of a p-phenylenediamine color developing agent,
(2) having a specific gravity of 1.2 or more,
(3) having pH of 13.3 or more,
(4) containing from 0.2 to 1 mol/liter of at least one compound selected from benzenesulfonic acids which may be substituted with an alkyl group and lactams, and
(5) not substantially containing alkanolamine.

2. A color developer replenisher for a silver halide color photographic material which is prepared by diluting the concentrated composition of a color developer replenisher as described in the above item 1 three to six times with water.

3. A method for processing a silver halide color photographic material which comprises processing a silver halide color photographic material with the color developer replenisher as described in the above item 2, wherein the temperature of a color developing solution is from 43 to 60° C., color developing time is 27 seconds or less, and the transfer speed of the photographic material in the color developing solution is a linear velocity of 27.8 mm/sec or more.

4. The method for processing a silver halide color photographic material as described in the above item 3, wherein the replenishing amount of the color developer replenisher is 50 ml or less per $m^2$ of a photographic material.

5. The concentrated composition of a color developer replenisher for a silver halide color photographic material as described in the above item 1, wherein the concentrated composition contains a benzenesulfinic acid compound.

6. The concentrated composition of a color developer replenisher for a silver halide color photographic material as described in the above item 1 or 5, wherein the concentrated composition contains a carboxybenzenesulfinic acid.

7. The concentrated composition of a color developer replenisher for a silver halide color photographic material as described in the above item 1, 5 or 6, wherein the concentrated composition contains a fluorescent brightening agent.

8. The concentrated composition of a color developer replenisher for a silver halide color photographic material as described in the above item 7, wherein the fluorescent brightening agent is a 4,4'-bis[3-(sulfoanilino)-s-triazinylamino]stilbene derivative.

When the concentrated composition of a color developer replenisher comprises the above constitution of the present invention, a color developing agent has high concentration, high pH, and stability not generating precipitation even when preserved under low temperature, and a color developer replenisher obtained by diluting the concentrated composition 3 to 6 times is capable of rapid development and/or low replenishing development of the developing time of 27 seconds or less and/or the replenishing rate of 50 ml/$m^2$ of a photographic material, moreover, the color developer replenisher is not accompanied by a creeping up phenomenon. Therefore, the precipitation of the constitutional components and the desensitization of a photographic material to be processed do not attend on the development, and the effects accordant to the objects of the invention can be exhibited. Further, as can be seen from the requisites for composition in the above item 1, this constitution sufficiently maintains the practicable cost of a concentrated composition.

Accordingly, by a color print system combining the color developer replenisher prepared from the above concentrated composition, a rapid processing type high silver chloride content photographic material described later, and a printer processor performing scanning exposure and development processing by a sheet transfer method at-a transfer speed of a photographic material of 27.8 mm/sec or more, quick print service satisfying the needs in the market becomes possible.

DETAILED DESCRIPTION OF THE INVENTION

<Composition of Concentrated Composition of Color Developer Replenisher>

A color developer replenisher can be made merely diluting the concentrated composition of a color developer replenisher of one-part constitution with a prescribed amount of water. Accordingly, the composition contains all the constitutional components of a color developer replenisher in a concentrated state and constitutes a stable system against temperature fluctuation and the like during storage. As the processing chemicals dissolved in the concentrated composition of a color developer replenisher, (1) a color developing agent as the essential constitutional component, (2) an alkali agent component for activating the color developing agent, (3) an antioxidant for preventing the oxidation deterioration of the color developing agent due to air oxidation (a preservative), (4) a water softener for sequestering metal impurities originating in water which cause turbidity of the developing solution and accelerate oxidation (a metal chelating agent), (5) a dissolution assistant for further thickening the concentration of the processing composition for compactification, (6) a surfactant for preventing foams from generating on the surface of a photographic material to be processed and in a development processing tank, (7) an antifoggant for preventing development fog and aerial fog, (8) a fluorescent brightening agent having the effects of improving the whiteness of white background of a finished photograph (in the case of a reflective print) and color image fastness, and (9) various processing chemicals, e.g., compounds for carrying out a necessary function according to the applying targets of other developing solutions, are generally included. Of each group, groups (1) to (3) are the constitutional components comprising the most general development processing agents, and groups (4) to (9) are not contained in some cases according to an objective photographic material and the processing form, and one compound may be selected from each group or a plurality of compounds may be used.

The concentrated composition of a color developer replenisher of the present invention satisfies the following essential requisites in the above constitution:

(1) containing 0.14 mol/liter or more of a p-phenylenediamine color developing agent,
(2) having a specific gravity of 1.2 or more,
(3) having pH of 13.3 or more,
(4) containing from,0.2 to 1 mol/liter of at least one compound selected from benzenesulfonic acids which may be substituted with an alkyl group and lactams, and
(5) not substantially containing alkanolamine.

The preferred ranges of the above requisites of the constitution of the composition are as follows.

Regarding (1), the preferred concentration of a color developing agent is from 0.15 to 0.20 mol/liter, and more preferably from 0.16 to 0.18 mol/liter.

Regarding (2), a specific gravity is preferably from 1.2 to 1.3, and more preferably from 1.22 to 1.28. The mechanism that a specific gravity value influences the stability of concentrated composition is unknown but this is the effect found by experience.

Regarding (3), pH is preferably from 13.3 to 13.5, and more preferably from 13.32 to 13.40.

Regarding (4), the preferred amount is from 0.25 to 0.5 mol/liter, and more preferably from 0.25 to 0.45 mol/liter, although the amount depends upon the used benzenesulfonic acids which may be substituted with an alkyl group and lactams.

Regarding (5), alkanolamines are specifically triethanolamine and triisopropanolamine, and "not substantially containing" means the concentration on which the influence of the addition of alkanolamine is not observed. The concentration is generally 3 g/liter or less. In many cases of carrying out the invention, the concentration of alkanolamine is 1 g/liter or less even if it were present, since alkanolamine is not added intentionally.

When concentrated composition deviates from the above constitution, one or more of the stability, the degree of concentration, the rapid processing performance and the low replenishing aptitude of the concentrated composition aimed at by the invention cannot be satisfied.

The representative examples of p-phenylenediamine color developing agents contained in the concentrated composition of a color developer replenisher of the invention are shown below, but the present invention is not limited thereto.

1) N,N-Diethyl-p-phenylenediamine
2) 4-Amino-3-methyl-N,N-diethylaniline
3) 4-Amino-N-(β-hydroxyethyl)-N-methylaniline
4) 4-Amino-N-ethyl-N-(β-hydroxyethyl)aniline
5) 4-Amino-3-methyl-N-ethyl-N-(β-hydroxyethyl)aniline
6) 4-Amino-3-methyl-N-ethyl-N-(3-hydroxypropyl)aniline
7) 4-Amino-3-methyl-N-ethyl-N-(4-hydroxybutyl)aniline
8) 4-Amino-3-methyl-N-ethyl-N-(β-methanesulfonamidoethyl)aniline
9) 4-Amino-N,N-diethyl-3-(β-hydroxyethyl)aniline
10) 4-Amino-3-methyl-N-ethyl-N-(β-methoxyethyl)aniline
11) 4-Amino-3-methyl-N-(β-ethoxyethyl)-N-ethylaniline
12) 4-Amino-3-methyl-N-(3-carbamoylpropyl)-N-n-propylaniline
13) 4-Amino-N-(4-carbamoylbutyl)-N-n-propyl-3-methylaniline
14) N-(4-Amino-3-methylphenyl)-3-hydroxypyrrolidine
15) N-(4-Amino-3-methylphenyl)-3-(hydroxymethyl) pyrrolidine
16) N-(4-Amino-3-methylphenyl)-3-pyrrolidinecarboxamide Of the above p-phenylenediamine derivatives, exemplified Compounds 5), 6), 7), 8) and 12) are preferred, and Compounds 5) and 8) are particularly preferred. These p-phenylenediamine derivatives generally take the form of salts such as sulfate, hydrochloride, sulfite, naphthalenedisulfonate, or p-toluenesulfonate when they are in the state of solid materials.

The amount of the aromatic primary amine developing agent used in processing composition is described above, and the concentration of a color developing agent in the developer replenisher prepared by diluting the composition with water from 3 to 6 times is from 2 to 200 mmol, preferably from 6 to 100 mmol, and more preferably from 10 to 40 mmol, per liter of the developer replenisher.

The compound selected from benzenesulfonic acids which may be substituted with an alkyl group and lactams to be contained in concentrated composition is described below.

The alkyl group substituted on a benzenesulfonic acid, is preferably an alkyl group having 3 or less carbon atoms, and more preferably a methyl group or an ethyl group. The position of substitution is mono- or di-substitution, and 4-position substitution is preferred in the former case and a 2,4-di-substitution product is preferred in the latter case.

The preferred benzenesulfonic acids which may be substituted with an alkyl group are a benzenesulfonic acid, a p-toluenesulfonic acid, a xylenesulfonic acid and a 4-ethylsulfonic acid, a benzenesulfonic acid and a p-toluenesulfonic acid are more preferred, and a p-toluenesulfonic acid is most preferred. These compounds may be used in the form of a free acid or in the form of an alkali metal salt, such as a potassium salt, a sodium salt or a lithium salt.

The preferred lactams are β-propiolactam, γ-butyrolactam, δ-valerolactam, ϵ-caprolactam, N-methyl-β-propiolactam, N-methyl-γ-butyrolactam, N-methyl-δ-valerolactam and N-methyl-ϵ-caprolactam, δ-valerolactam and ϵ-caprolactam are more preferred, and ϵ-caprolactam is most preferred.

Concentrated composition may contain either benzenesulfonic acids or lactams, and the above range is preferred as the addition amount. Even if the addition amount exceeds the above range or less than the above range, the concentration of a color developing agent in the composition lowers and stability decreases.

By containing a benzenesulfinic acid compound, the stability against air oxidation of concentrated composition is improved, and a creeping up phenomenon is difficult to occur. The preferred benzenesulfinic acid compounds are an m-carboxybenzenesulfinic acid, ap-carboxybenzenesulfinic acid, a 2,4-dicarboxybenzenesulfinic acid and a 4-acetylcarboxybenzenesulfinic acid, and m-carboxybenzenesulfinic acid is preferred of them. These compounds may be used in the form of a free acid or in the form of an alkali metal salt, such as a potassium salt, a sodium salt or a lithium salt.

The addition amount of a benzenesulfinic acid compound is from 0.2 to 1 mol, preferably from 0.5 to 1 mol, per liter of concentrated composition.

It is preferred for the concentrated composition of a color developer replenisher of the invention to contain a fluorescent brightening agent. The preferred fluorescent brightening agents are bis(triazinylamino)stilbene sulfonic acid compounds. As the bis(triazinylamino)stilbene sulfonic acid compounds, well-known or commercially available aminostilbene series brightening agents can be used. As well-known bis (triazinylamino) stilbene sulfonic acid compounds, the compounds disclosed in JP-A-6-329936, JP-A-7-140625 and JP-A-10-140849 are preferred. Commercially available compounds are described, e.g., in *Senshoku Note* (*Coloring Note*), Ninth Edition, pp. 165 to 168, Shikisensha Co., Ltd. and of the compounds described ibid., Blankophor BSU liq. and Hakkol BRK, and the fluorescent brightening agent shown below are preferred.

Of bis(triazinylamino)stilbene sulfonic acid fluorescent brightening agents, a compound represented by the following formula (II) is particularly preferred, since it is effective for the stability of the composition.

(II)

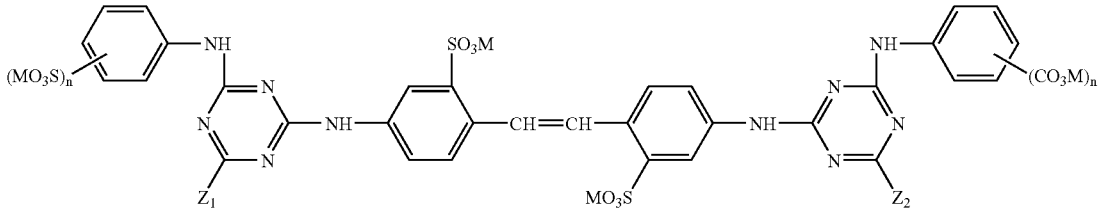

wherein $Z_1$ and $Z_2$, which may be the same or different, each represents an amino group having from 2 to 3 carbon atoms substituted with a hydroxyl group or a sulfonic acid group; and M represents a hydrogen atom, or an alkali metal atom, e.g., sodium, potassium or lithium. The specific examples of the compounds represented by formula (II) are shown below, but the invention is not limited thereto.

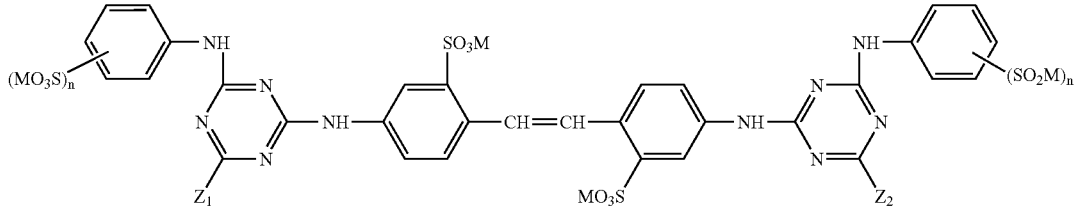

| Cpd. No. | $Z_1$ | $Z_2$ |
|---|---|---|
| II-1 | $-NHCH_2CH(CH_3)SO_3K$ | $-NHCH_2CH(CH_3)SO_3K$ |
| II-2 | $-N(C_2H_4OSO_3K)_2$ | $-N(C_2H_4OSO_3K)_2$ |
| II-3 | $-NHC_2H_4SO_3Na$ | $-NHC_2H_4SO_3Na$ |
| II-4 | $-NHC_2H_4SO_3H$ | $-NHC_2H_4SO_3H$ |
| II-5 | $-NHC_2H_4SO_3K$ | $-NHC_2H_4SO_3K$ |
| II-6 | $-N(CH_3)(C_2H_4SO_3K)$ | $-N(CH_3)(C_2H_4SO_3K)$ |
| II-7 | $-N(C_2H_5)(C_2H_4SO_3K)$ | $-N(C_2H_5)(C_2H_4SO_3K)$ |
| II-8 | $-N(C_2H_4SO_3K)_2$ | $-N(C_2H_4SO_3K)_2$ |
| II-9 | $-N(C_2H_4SO_3K)_2$ | $-NHC_2H_4OH$ |

-continued

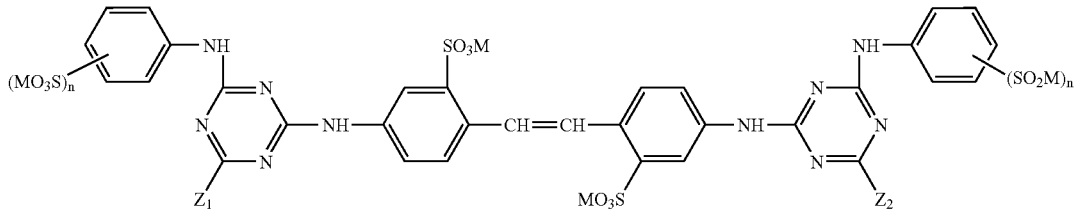

| Cpd. No. | $Z_1$ | $Z_2$ |
|---|---|---|
| II-10 | $-NHC_2H_4SO_3Na$ | $-N(CH_3)(C_2H_4SO_3K)$ |
| II-11 | $-NHC_2H_4SO_3Na$ | $-N(C_2H_4OSO_3K)(C_2H_4OSO_3K)$ |
| II-12 | $-NHC_2H_4SO_3Na$ | $-NHCH_2CH(OH)CH_3$ |
| II-13 | $-N(C_2H_4OH)(C_2H_4OH)$ | $-N(C_2H_4OH)(C_2H_4OH)$ |
| II-14 | $-N(C_2H_4OH)(C_2H_4OH)$ | $-NHC_2H_4OH$ |
| II-15 | $-NHC_2H_4OH$ | $-N(CH_3)(C_2H_4OH)$ |
| II-16 | $-NHC_2H_4OH$ | $-N(C_2H_4OH)(C_2H_4OH)$ |
| II-17 | $-NHC_2H_4OH$ | $-NHC_2H_4OH$ |
| II-18 | $-NHCH_2CH(OH)CH_3$ | $-N(CH_3)(C_2H_4OH)$ |
| II-19 | $-NHCH_2CH(OH)CH_3$ | $-NHCH(CH_3)CH_2OH$ |
| II-20 | $-NHCH_2CH(OH)CH_3$ | $-N(C_2H_4OH)(C_2H_4OH)$ |
| II-21 | $-NHCH_2CH(OH)CH_3$ | $-NHC_2H_4OH$ |
| II-22 | $-NHCH_2CH(OH)CH_3$ | $-NHCH_2CH(OH)CH_3$ |

Among the compounds represented by formula (II), the compounds represented by II-3, II-4, II-5, II-8, II-13 and II-17 are preferred, and II-13 is particularly preferred.

These compounds are contained in the concentrated composition so that the concentration of these compounds in a color developer replenisher prepared from the concentrated composition becomes preferably from 1 to 20 g/liter, more preferably from 2 to 15 g/liter, and particularly preferably from 5to 15 g/liter. Further, two or more compounds represented by formula (II) can be used at the same time, or the compound represented by formula (II) may be used in combination with other triazinylstilbene compound. When the compound represented by formula (II) is used in combination with other compound, the compound represented by formula (II) accounts for 30% or more of the entire amount of fluorescent brightening agent, preferably 40% or more. The compounds represented by formula (II) can be synthesized according to well-known methods, and they are commercially available.

The concentrated composition of a color developer replenisher of the invention can be applied to color photographic materials for photographing and printing, but the effect of the invention is exhibited particularly when the composition is applied to color paper.

The constitutional chemicals other than the above-described characteristic constitution of the concentrated composition of a color developer replenisher of the present invention are described below. Instead of describing each of the processing composition and the replenisher prepared by diluting the processing composition with a prescribed rate of water, they are described together, and with respect to the concentrations of components, the concentration of the working solution is mainly described.

A color developing composition (color-forming development and color development, which is a broader term of color-forming development, are the same meaning in the specification of the invention) contains a small amount of sulfite ion in some case according to the kinds of objective photographic material, or does not substantially contain in another case, but it is preferred to contain a small amount of sulfite ion in the present invention. A sulfite ion sometimes adversely affects photographic characteristics during color developing process in an oversupplied case, although it has conspicuous preservative property.

A color developing composition may contain a small amount of hydroxylamine. When hydroxylamine (hydroxylamine is generally used in the form of hydrochloride or sulfate but the form of a salt is omitted hereinafter) is contained, it functions as the preservative of a developing solution as a sulfite ion, but hydroxylamine sometimes affects photographic characteristics due to the silver development activity of hydroxylamine itself. Therefore, the addition amount should be limited to a small amount.

A color developing composition may contain organic preservatives besides hydroxylamine and a sulfite ion. Organic preservatives means the organic compounds generally which reduce the deterioration speed of an aromatic primary amine color developing agent when added to the processing solution of a photographic material. That is, organic preservatives are organic compounds having a function to prevent the air oxidation of a color developing agent and, above all, hydroxylamine derivatives, hydroxamic acids, hydrazides, phenols, α-hydroxyketones, α-aminoketones, saccharides, monoamines, diamines, polyamines, quaternary ammonium salts, nitroxy radicals, alcohols, oximes, diamide compounds, and condensed ring amines are particularly effective organic preservatives. These organic preservatives are disclosed in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503, 2,494,903, JP-A-52-143020, and JP-β-48-30496 (the term "JP-B" as used herein means an "examined Japanese patent publication").

In addition, the various metals disclosed in JP-A-57-44148 and JP-A-57-53749, the salicylic acids disclosed in JP-A-59-180588, the polyethyleneimines disclosed in JP-A-56-94349, and the aromatic polyhydroxyl compounds disclosed in U.S. Pat. No. 3,746,544 may be used as preservatives, if necessary. In particular, substituted or unsubstituted dialkylhydroxylamine e.g., disulfoethylhydroxylamine and diethylhydroxylamine, or aromatic polyhydroxyl compounds are preferably used.

Of the above organic preservatives, details of substituted hydroxylamine are disclosed in JP-A-1-97953, JP-A-1-186939, JP-A-1-186940 and JP-A-1-187557. Addition of substituted hydroxylamines and amines together is sometimes effective for improving the stability of a color developing solution and the stability at the time of continuous processing.

As the examples of amines, the cyclic amines as disclosed in JP-A-63-239447, the amines as disclosed in JP-A-63-128340, and the amines as disclosed in JP-A-1-186939 and JP-A-1-187557 can be exemplified. The content of preservatives in a processing agent differs in accordance with the kind of preservatives but they are generally added so that the concentration in a working solution becomes from 1 to 200 mmol, preferably from 10 to 100 mmol, per liter of the developing solution.

If necessary, chlorine ions may be added to a color developing composition, e.g., a developing composition for color paper. In many cases, a color developing solution (in particular, a developer for color print materials) contains chlorine ions in an amount of from $3.5\times10^{-2}$ to $1.5\times10^{-1}$ mol/liter, but since chlorine ions are released into a developing solution as the by-product of development, it is generally not necessary to add them to the developing composition for a replenisher. The developing composition for photographic materials for photographing may not contain chlorine ions.

With respect to bromine ions, the concentration of bromine ions in a color developing solution is preferably from 1 to $5\times10^{-3}$ mol/liter or so for processing the materials for photographing and $1.0\times10^{-3}$ mol/liter or less for processing the materials for printing. It is not necessary to add bromine ions to the composition for a color developer replenisher in many cases similarly to the above chlorine ions, but when added, they are added to the processing agent according to necessity so that the concentration becomes the above range.

When the materials to be processed are a color negative film and a color reversal film obtained from a silver iodobromide emulsion, the state of things with the iodine ions is also the same with the above. Iodine ions are generally released from a photographic material into a developing solution and the iodine ion concentration becomes from 0.5 to 10 mg or so per liter of a developing solution, so that iodine ions are not generally contained in the processing composition for a replenisher.

In the present invention, it is preferred to set the pH of the developing solution in a developing tank from 9.0 to 12.5, accordingly the pH of the developer replenisher from 9.0 to 13.5, so that an alkali agent, a buffer and, if necessary, an acid agent can be added to maintain these pH values.

As the alkalis, various kinds of hydroxides can be used, e.g., potassium hydroxide, sodium hydroxide, lithium hydroxide, tripotassium hydrogenphosphate, trisodium hydrogenphosphate and hydrates of these hydroxides, or triethanolamine and diethanolamine can be exemplified. As the acid agents to be added according to necessity, inorganic and organic water-soluble solid state acids, e.g., succinic acid, tartaric acid, propionic acid and ascorbic acid can be used.

It is preferred to use various buffers to maintain the above pH range when a processing solution is prepared. The examples of the buffers which can be used in the present invention include carbonate, phosphate, borate, tetraborate, hydroxybenzoate, glycyl salt, N,N-dimethylglycine salt, leucine salt, norleucine salt, guanine salt, 3,4-dihydroxyphenylalanine salt, alanine salt, aminobutyrate, 2-amino-2-methyl-1,3-propanediol salt, valine salt, proline salt, trishydroxyaminomethane salt, and lysine salt. Carbonate, phosphate, tetraborate and hydroxybenzoate are particularly excellent in buffering ability in a high pH range of pH 9.0 or more, and do not adversely affect photographic properties (e.g., to cause fogging) when added to a color developing solution and inexpensive, therefore, these buffers are particularly preferably used.

The specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium5-sulfo-2-hydroxybenzoate (sodium 5-sulfosalicylate), and potassium 5-sulfo-2-hydroxybenzoate (potassium 5-sulfosalicylate). However, the present invention is not limited thereto.

Since a buffer is not a component which is reacted and consumed, the addition amount to the composition is set so that the concentration of a developer replenisher prepared from the processing agent becomes from 0.01 to 2 mol, preferably from 0.1 to 0.5 mol, per liter of the developer replenisher.

Various chelating agents, which are a precipitation preventive of other developing solution components, e.g., calcium and magnesium, or a stability improver of a color developing solution, can also be added to a color developing composition. The examples of chelating agents include nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, trans-cyclohexanediaminetetraacetic acid, 1,2-diaminopropanetetraacetic acid, glycol ether diaminetetraacetic acid, ethylenediamine-o-hydroxyphenylacetic acid, ethylenediaminedisuccinic acid (SS body), N-(2-carboxylatoethyl)-L-aspartic acid, β-alaninediacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid, and 1,2-dihydroxybenzene-4,6-disulfonic acid.

These chelating agents may be used in combination of two or more, if necessary.

The addition amount of these chelating agents should be the amount sufficient to sequester metal ions in a color developer replenisher prepared, e.g., from about 0.1 g to about 10 g per liter.

The color developing composition of the invention can contain an arbitrary development accelerator, if necessary. For example, the thioether-based compounds disclosed in JP-B-37-16088, JP-B-37-5987, JP-B-38-7826, JP-B-44-12380, JP-B-45-9019 and U.S. Pat. No. 3,813,247, the p-phenylenediamine-based compounds disclosed in JP-A-52-49829 and JP-A-50-15554, the quaternary ammonium salts disclosed in JP-A-50-137726, JP-B-44-30074, JP-A-56-156826 and JP-A-52-43429, the amine-based compounds disclosed in U.S. Pat. Nos. 2,494,903, 3,128,182, 4,230,796, 3,253,919, JP-B-41-11431, U.S. Pat. Nos. 2,482,546, 2,596,926, and 3,582,346, and the polyalkylene oxides disclosed in JP-B-37-16088, JP-B-42-25201, U.S. Pat. No. 3,128,183, JP-B-41-11431, JP-B-42-23883 and U.S. Pat. No. 3,532,501, and also 1-phenyl-3-pyrazolidones and imidazoles can be added as a development accelerator according to necessity. The addition amount of these compounds is decided so that the concentration of a developing solution and a developer replenisher prepared from the processing agent-becomes from 0.001 to 0.2 mol/liter, and preferably from 0.0 to 0.05 mol/liter.

Besides the foregoing halogen ions, an arbitrary antifoggant can be added to the color developing composition for use in the invention, if necessary. The representative examples of organic antifoggants include, e.g., nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine and adenine.

Further, the color developer for use in the present invention can contain various surfactants, if required, e.g., an alkylsulfonic acid, an arylsulfonic acid, an aliphatic carboxylic acid, and an aromatic carboxylic acid can be used. The addition amount of these compounds to the composition is set so that the concentration of a developing solution and a developer replenisher prepared from the processing agent becomes from 0.0001 to 0.2 mol/liter, and preferably from 0.001 to 0.05 mol/liter.

Water is generally used as the solvent of concentrated composition, but a water-soluble solvent may be used for increasing the solubility. When a water-soluble solvent is used, a mixed solvent containing from 1 to 20 mass % of a water-miscible organic solvent, e.g., diethylene glycol, triethylene glycol, or ethylene glycol, which increases the solubility of a developing agent, is selected with water as a main component.

As the bleaching agents which are used for processing in combination with the above color development processing composition, well-known bleaching agents in addition to iron(III) complex salts of aminopolycarboxylic acid can be used. The bleaching agents which can be used in combination include iron(III) complex salts of organic acids, e.g., citric acid, tartaric acid and malic acid, persulfate, and hydrogen peroxide are exemplified.

The preferred examples of aminopolycarboxylic acids iron(III) complex salts are the iron(III) complex salts of the following aminopolycarboxylic acids, e.g., biodegradable ethylenediaminedisuccinic acid (SS body), N-(2-carboxylato-ethyl)-L-aspartic acid, β-alaninediacetic acid, methyliminodiacetic acid, ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, iminodiacetic acid, and glycol ether diaminetetraacetic acid can be exemplified. These compounds may be any form of sodium salts, potassium salts, lithium salts and ammonium salts. Of these compounds, ethylenediaminedisuccinic acid (SS body), N-(2-carboxylato-ethyl)-L-aspartic acid, β-alaninediacetic acid; ethylene-diaminetetraacetic acid, 1,3-diaminopropanetetraacetic acid, and methyliminodiacetic acid are preferred, since the iron (III) complex salts of these compounds are excellent in photographic characteristics. These iron(III) complex salts may be used in the form of complex salt, or iron(III) complex salts may be formed in a solution by using ferric salts, e.g., ferric sulfate, ferric chloride, ferric nitrate, ferric ammonium sulfate and ferric phosphate with a chelating agent such as aminopolycarboxylic acid. A chelating agent is used in an amount excessively higher than the amount for forming an iron(III) complex salt.

The concentration of the bleaching agent in a bleaching agent part is decided so that the concentration of the bleaching agent in a processing solution prepared from the processing composition becomes from 0.01 to 1.0 mol/liter, preferably from 0.03 to 0.80 mol/liter, still more preferably from 0.05 to 0.70 mol/liter, and most preferably from 0.07 to 0.50 mol/liter.

It is preferred that a bleaching agent part contains various well-known organic acids (e.g., acetic acid, lactic acid, glycolic acid, succinic acid, maleic acid, malonic acid, citric acid, sulfo succinic acid, tartaric acid, glutaric acid), organic bases (e.g., imidazole, dimethylimidazole), or a compound represented by formula (A-a) disclosed in JP-A-9-211819 including 2-picolic acid, and a compound represented by formula (B-b) disclosed in the same patent including kojic acid. The addition amount of these compounds is set so that the concentration of the processing solution prepared becomes preferably from 0.005 to 3.0 mol/liter, and more preferably from 0.05 to 1.5 mol/liter. The organic acids are preferably monobasic acids and dibasic acids, and dibasic acids are more preferred, since they are low volatile, odorless and have great buffering performance at pH 2 to 3.5.

A fixing agent part which constitutes the processing composition of a bleach-fixing solution in combination with the bleaching agent part can contain well-known fixing chemicals as the fixing agent, for example, one or two or more compounds selected from water-soluble silver halide solvents can be used as mixture, such as thiosulfates, e.g., sodium thiosulfate and ammonium thiosulfate, thiocyanates, e.g., sodium thiocyanate and ammonium thiocyanate, thioether compounds, e.g., ethylenebis-thioglycolic acid and 3,6-dithia-1,8-octanediol, and thioureas. Further, a specific bleach-fixing solution comprising a combination of a fixing agent and a great amount of halide, e.g., potassium iodide, as disclosed in JP-A-55-155354 can also be used in the present invention. Thiosulfate, in particular, ammonium thiosulfate, is preferably used in the present invention. The addition amount of the fixing chemicals in a fixing agent part is set so that the concentration of the prepared bleach-fixing solution becomes preferably from 0.3 to 3 mol, more preferably from 0.5 to 2.0 mol, per liter of the solution.

It is preferred that the fixing agent part contains, as a preservative, sulfite ion-releasing compounds such as sulfite (e.g., sodium sulfite, potassium sulfite and ammonium sulfite), bisulfite (e.g., ammonium bisulfite, sodium bisulfite and potassium bisulfite), and metabisulfite (e.g., potassium metabisulfite, sodium metabisulfite and ammonium metabisulfite), and arylsulfinic acids such as p-toluenesulfinic acid and m-carboxybenzenesulfinic acid. It is preferred to contain these compounds in an amount of from about 0.02 to about 1.0 mol/liter (as the concentration of the prepared processing solution) in terms of a sulfite ion or sulfinate ion.

In addition to the above compounds, ascorbic acid, carbonyl-bisulfite adducts and carbonyl compounds can be used as a preservative.

A bleach-fixing solution prepared by mixing a bleaching agent part and a fixing agent part and adding, if necessary, a small amount of water is described below. The constitutional components of bleach-fixing solution which may be contained in either a bleaching agent part or a fixing agent part are also described below.

The pH at the time of dissolution of the processing composition of a bleach-fixing solution is preferably from 3 to 8, and more preferably from 4 to 8. When the pH is lower than this range, the solution is deteriorated and cyan dyes become leuco dyes acceleratedly, although desilvering property is improved. While when the pH is higher than this range, desilvering is delayed and stains are liable to occur.

For adjusting pH, if necessary, alkalis, e.g., potassium hydroxide, sodium hydroxide, lithium hydroxide, lithium carbonate, sodium carbonate and potassium carbonate, and acidic or alkaline buffers can be added to a fixing agent part.

Other various kinds of fluorescent brightening agents, defoaming agents, surfactants or polyvinyl pyrrolidone can be added to either one part or both parts of the processing composition of a bleach-fixing solution.

In the next place, color development processing steps using the concentrated composition of a color developer replenisher of the present invention are described below.

The color development process to which the concentrated composition of a color developer replenisher of the invention is applied comprises a color developing step, a desilvering step, a washing or stabilizing step, and a drying step. Auxiliary steps, e.g., a rinsing step, an intermediate washing step, a neutralizing step, etc., can be provided between each of the above steps. A desilvering step is performed in one-step process of a bleach-fixing step. Besides a stabilizing bath substituting for a washing bath, an image stabilizing bath for the purpose of stabilizing images can be provided between a washing step or a stabilizing step and a drying step.

The development process according to the present invention is designed so as to be suitable for rapid process or low replenishing process, and the replenishing rate of a color developer replenisher is 50 ml or less per $m^2$ of a photographic material, preferably from 20 to 50 ml, more preferably from 25 to 45 ml, and most preferably from 25 to 40 ml. The replenishing rate of a bleach-fixing solution is preferably from 20 to 60 ml per $m^2$ of a photographic material, more preferably from 25 to 50 ml, and most preferably from 25 to 45 ml. The replenishing rate of a bleach-fixing solution is preferably divided to a bleaching agent part and a fixing agent part, and in this case, the replenishing rate of the bleach-fixing solution is the sum total of the replenishing rates of the bleaching agent part and the fixing agent part. The replenishing rate of a rinsing solution (a washing water and/or a stabilizing solution) is from 50 to 200 ml as the total of the rinsing solution.

Color development time (i.e., the time required for performing color development process) is preferably 45 seconds or less, more preferably 30 seconds or less, still more preferably 27 seconds or less, particularly preferably from 25 to 6 seconds, and most preferably from 20 to 6 seconds. Bleach-fixing time (i.e., the time required for performing bleach-fixing process) is preferably 45 seconds or less, more preferably 30 seconds or less, still more preferably from 25 to 6 seconds, and particularly preferably from 20 to 6 seconds. Rinsing (water washing or stabilization) time (i.e., the time required for performing rinsing process) is preferably 90 seconds or less, more preferably 30 seconds or less, and still more preferably from 30 to 6 seconds.

Color developing time means the time since a photographic material enters a color developing solution until it enters the subsequent bleach-fixing solution. For example, when an automatic processor is used for processing, color developing time is the sum total of the time of a photographic material being immersed in a color developing solution (so-called time in a solution) and the time of coming out of the developing solution and being transferred to the subsequent bleach-fixing solution (so-called time in the air). Similarly, bleach-fixing time means the time since the photographic material enters a bleach-fixing solution until it enters the subsequent water-washing or stabilizing bath. Further, rinsing (water-washing or stabilization) time means the time since the photographic material enters a rinsing solution (water-washing or stabilizing solution) and is in the solution before drying step (so-called time in a solution).

The temperature of the processing solutions in a color development process, a bleach-fixing process and a rinsing process is generally from 30 to 40° C., but the processing solution temperature in rapid processing is preferably from 38 to 60° C., and more preferably from 40 to 50° C.

The amount of a rinsing solution can be set in a wide range according to the characteristics of a photographic material (e.g., by the materials used such as couplers and the like) and the application, the temperature of a rinsing solution (a washing water), the number (of washing stages) of a rinsing solution (water-washing tanks), and other various conditions. Of these conditions, the relationship between the number of rinsing tanks (water-washing tanks) and the amount of water in a multistage counter current system can be obtained by the method described in *Journal of the Society of Motion Picture and Television Engineers*, Vol. 64, pp. 248 to 253 (May, 1955).

The number of stages in a multistage countercurrent system is generally preferably from 3 to 15, and particularly preferably from 3 to 10.

According to a multistage countercurrent system, the amount of a rinsing solution can be greatly reduced, however, problem arises that bacteria proliferate due to the increased residence time of water in the tank, and suspended matters produced thereby adhere to a photographic material. Using the later-described rinsing solution containing antibacterial and antifungal agents is very effective means for overcoming the problem.

A development-processed silver halide color photographic material is subjected to post-treatment, e.g., a drying process. In a drying process, it is also possible to expedite drying by absorbing water just after development process (rinsing process) by means of a squeegee and cloth from the viewpoint of reducing the carryover of water to the image film. It is a matter of course that drying can be expedited by increasing temperature and modulating the shape of a blasting nozzle to strengthen the dry air. Moreover, as is disclosed in JP-A-3-157650, the adjustment of the blowing angle of dry air to a photographic material and discharging methods of exhaust air are also effective to speed up drying.

The development processing of the invention is performed with an automatic processor. Automatic processors which are preferably used in the invention are described below.

It is preferred in the present invention that the linear velocity of conveyance of automatic processors is preferably 100 mm/second or less, more preferably from 27.8 to 80 mm/second, and particularly preferably from 27.8 to 50 mm/second.

With automatic processors for color papers, there are systems of conveyance by, e.g., performing development processing after cutting a color paper to a final size (a sheet-type conveying system), and by performing development processing of a color paper in a long rolled state and cutting the color paper to a final size after development processing (a cinema-type conveying system). A sheet type conveying system is preferred, since about 2 mm between-images is wasted on a photographic material with cinema-type conveying system.

It is preferred that the contact area of air with the processing solution in a processing tank and a replenisher tank (open area) of the invention is as small as possible. For example, taking the value obtained by dividing the open area ($cm^2$) by the volume of the processing solution in a tank ($cm^3$) as the open factor, the open factor is preferably 0.01 ($cm^{-1}$) or less, more preferably 0.005 or less, and most preferably 0.001 or less.

It is preferred to provide a solid or liquid non-contact means with air which is floating on the surface of the solution in a processing tank or a replenisher tank to reduce the area being in contact with air.

Specifically, means of floating a floating lid of plastics on the liquid level or covering the liquid level with a liquid immiscible with and not chemically reacting with a processing solution are preferred. Liquid paraffin and liquid saturated hydrocarbon are preferred examples of such liquids.

The crossover time required for a photographic material to transfer from one processing tank to another processing tank in the air is preferably as short as possible for carrying out processing rapidly, preferably 10 seconds or less, more preferably 7 seconds or less, and most preferably 5 seconds or less.

Further, the structure of a crossover rack which is provided with a mixture-inhibiting plate is preferably used in the present invention for shortening the crossover time and inhibiting the mixture of the processing solutions.

As a method to completely get rid of crossover time, it is particularly preferred to use the submerged conveying structure by blades disclosed in JP-A-2002-55422. According to this method, crossover time can be made zero by providing a blade between processing tanks, to thereby prevent a solution from leaking and pass a photographic material.

It is particularly preferred to provide the above submerged conveying structure by blades with the liquid circulating structure having the downward liquid-circulating direction disclosed in Japanese Patent Application No. 2001-147814, and set up a pleated filter of a porous material in the system of circulation.

It is preferred in the present invention that the amount corresponding to each evaporated processing solution be replenished with water, that is, a so-called evaporation compensation, and it is particularly preferred with regard to a color developing solution and a bleach-fixing solution.

There is no particular limitation on the specific method of replenishing water, but the following methods disclosed in JP-A-1-254959 and JP-A-1-254960 are preferred above all, e.g., the method of arranging a monitoring water tank separately from the bleach-fixing tank, and computing the amount of water evaporated from the bleach-fixing tank from the amount of water evaporated from the monitoring water tank, and replenishing water to the bleach-fixing tank in proportion to the amount of evaporation, and the method of using a liquid level sensor or an overflow sensor to compensate for the evaporated amount of water. The most preferred evaporation compensation method is the method of adding the presumed amount of water corresponding to the evaporation amount computed from the coefficient determined in advance based on the data of operating time, stopping time and temperature controlling time of the automatic processor, which is described in *Nippon Hatsumei*

*Kyokai Kokai Giho,* 94-49925, line 26, right column, page 1 to line 28, left column, page 3.

Further, means to decrease the evaporation amount are necessary, e.g., reducing the open area or controlling the air capacity of an exhaust fan are required. The preferred open factor of a color developing solution is as described above, but it is also preferred to reduce open areas with respect to other processing solutions as well.

As a means to decrease the evaporation amount, "maintaining the humidity of the upper space of a processing tank at 80% RH or more" as disclosed in JP-A-6-110171 is particularly preferred, and it is especially preferred to equip an automatic processor with the evaporation preventing rack and the automatic roller washing mechanism illustrated in FIGS. 1 and 2 of the above patent. An exhaust fan is generally installed for preventing dew condensation during temperature controlling. A displacement is preferably from 0.1 to 1 $m^3$/minute, and particularly preferably from 0.2 to 0.4 $m^3$/minute.

Drying conditions of a photographic material also affect the evaporation of a processing solution. A ceramic hot air heater is preferably used for drying, and a supply air capacity is preferably from 4 to 20 $m^3$/minute, and particularly preferably from 6 to 10 $m^3$/minute.

A superheating-preventing thermostat of a ceramic hot air heater is preferably a system actuated by heat transfer and the thermostat is preferably installed on the leeward or on the windward of the radiation fin or the heat transfer part. Drying temperature is preferably controlled according to the water content of the photographic material to be processed, and the optimal temperature ranges are from 45 to 55° C. in the case of an APS format and a 35 mm width film and from 55 to 65° C. in the case of a Brownie film. The drying time is preferably from 5 seconds to 2 minutes, and particularly preferably from 5 to 60 seconds.

A replenishing pump is used in replenishing a processing solution, and a bellows type replenishing pump is preferably used. As a method of improving the accuracy of replenishment, making the diameter of a liquid-feeding pipe to a replenishing nozzle smaller is effective to prevent the backflow at stopping time. The inside diameter of the liquid-feeding pipe is preferably from 1 to 8 mm, and particularly preferably from 2 to 5 mm.

There are used various materials of parts in an automatic processor, and preferred materials are described below.

Modified PPO (modified polyphenylene oxide) and modified PPE (modified polyphenylene ether) resins are preferred as the materials of tanks such as a processing tank and a temperature controlling tank. The example of modified PPO includes "Noryl" (manufactured by Nippon G.E. Plastics Co.), and the examples of modified PPE include "Zailon" (manufactured by Asahi Chemical Industry Co., Ltd.) and "Yupiace" (manufactured by Mitsubishi Gas Chemical Co., Inc.). Further, these materials are suitable for a processing rack or the parts which are possible to be in contact with a processing solution, e.g., a crossover.

PVC (polyvinyl chloride), PP (polypropylene), PE (polyethylene) and TPX (polymethylpentene) resins are suitable as the materials for the roller of a processing part. In addition, these materials are usable for other parts which are possible to be in contact with a processing solution. A PE resin is also preferred as the material for a replenisher tank made by blow molding.

PA (polyamide), PBT (polybutylene terephthalate), UHMPE (ultrahigh molecular weight polyethylene), PPS (poly-phenylene sulfide), LCP (total aromatic polyester resin, liquid crystal polymer) resins are preferred as the materials for processing parts, gears, sprockets and bearings.

A PA resin is a polyamide resin, e.g., 66 nylon, 12 nylon and 6 nylon, and those containing glass fibers and carbon fibers are fast to swelling by processing solutions and usable in the present invention.

High molecular weight products such as an MC nylon and a compression-molded product are usable without fiber reinforcement. A UHMPE resin is preferably not reinforced, and the preferred and commercially available products of UHMPE resins include "Lubmer" and "Hizex Million" (manufactured by Mitsui Petrochemical Industries, Ltd.), "New Light" (manufactured by Sakushin Kogyo Co., Ltd.), and "Sunfine" (manufactured by Asahi Chemical Industry Co., Ltd.). The molecular weight of these products is preferably 1,000,000 or more, and more preferably from 1,000,000 to 5,000,000.

PPS resins are preferably reinforced with glass fibers or carbon fibers. The examples of commercially available LCP resins include "Victrex" (manufactured by ICI Japan Co., Ltd.) "Ekonol" (manufactured by Sumitomo Chemical Co., Ltd.), "Zaider" (manufactured by Nippon Oil Co., Ltd.), and "Vectra" (manufactured by Polyplastics Co., Ltd.).

Ultrahigh tenacity polyethylene fibers or polyvinylidene fluoride resins disclosed in Japanese Patent Application No. 2-276886 are preferably used as the materials of a conveyor belt.

Vinyl chloride foam resins, silicone foam resins and urethane foam resins are preferred as the soft materials for squeegee rollers and the like. The example of urethane foam resin includes "Lubicel" (manufactured by Toyo Polymer Co., Ltd.).

An EPDM rubber, a silicone rubber and a byton rubber are preferably used as the rubber materials for the coupling of piping, the coupling of an agitation jet pipe and sealing materials.

It is also preferred that chemicals are directly added to a processing tank together with water corresponding to a diluting rate. Further, it is also preferred to make a replenisher automatically by dissolving and diluting chemicals in a replenisher tank by using an automatic preparing unit.

It is preferred that the processing chemicals for use in the invention are made a product form for every process independently, or it is also preferred to use the processing chemicals of each process in the form of a kit en bloc, and it is further preferred that in the latter case also processing chemicals for a replenisher are capable of being attached to and detached from an automatic processor in one lot as a cartridge form. The materials of these containers of the processing agent may be any of paper, plastics, metals and the like. Apart from the container for a bleaching agent-containing processing agent, plastic materials having an oxygen permeation coefficient of $57\times10^{-6}$ ml/Pa·$m^2$·s (50 ml/$m^2$·atm·day) or less are preferred. An oxygen permeation coefficient can be measured in accordance with the method described in $O_2$ *Permeation of Plastic Container, Modern Packing*, pp. 143 to 145, N.J., Calyan (December, 1968).

The specific examples of preferred plastic materials include vinylidene chloride (PVDC), nylon (NY), polyethylene (PE), polypropylene (PP), polyester (PES), ethylene-vinyl acetate copolymer (EVA), ethylene-vinyl alcohol copolymer (EVAL), polyacrylonitrile (PAN), polyvinyl alcohol (PVA), and polyethylene terephthalate (PET).

Apart from the container for a bleaching agent-containing processing agent, the use of PVDC, NY, PE, EVA, EVAL and PET is preferred for the purpose of reducing oxygen permeability.

These materials maybe used alone, molded, or a plurality of sheets may be laminated (a so-called composite film).

Various shapes of containers, e.g., a bottle type, a cubic type, or a pillow type can be used in the invention, but a cubic type and analogous structures are particularly preferably used, since they are flexible, easily handleable, and the volume can be reduced after use.

When these plastic materials are used as composite films, the structures shown below are particularly preferably used, but the invention should not be construed as being limited thereto. That is, PE/EVAL/PE, PE/aluminum foil/PE, NY/PE/NY, NY/PE/EVAL, PE/NY/PE/EVAL/PE, PE/NY/PE/PE/PE/NY/PE, PE/$SiO_2$ film/PE, PE/PVDC/PE, PE/NY/aluminum foil/PE, PE/PP/aluminum foil/PE, NY/PE/PVDC/NY, NY/EVAL/PE/EVAL/NY, NY/PE/EVAL/NY, NY/PE/PVDC/NY/EVAL/PE, PP/EVAL/PE, PP/EVAL/PP, NY/EVAL/PE, NY/aluminum foil/PE, paper/aluminum foil/PE, paper/PE/aluminum foil/PE, PE/PVDC/NY/PE, NY/PE/aluminum foil/PE, PET/EVAL/PE, PET/aluminum foil/PE, and PET/aluminum foil/PET/PE are exemplified.

The thickness of the above composite films is from 5 to 1,500 μm or so, and preferably from 10 to 1,000 μm or so. The volume of finished containers is from 100 ml to 20 liters or so, and preferably from 500 ml to 10 liters or so.

The above containers (cartridges) may have a case of corrugated cardboard or plastics or the containers maybe molded integrally with the case.

The cartridge of the present invention can be charged with various processing solutions, e.g., a color developing solution, a black-and-white developing solution, a bleaching solution, a compensating solution, a reversal solution, a fixing solution, a bleach-fixing solution, and a stabilizing solution. Cartridges in particular having a low oxygen permeation coefficient are suitable for containing a color developing solution, a black-and-white developing solution, a fixing solution and a bleach-fixing solution.

Conventionally used rigid containers for processing solutions of a monolayer material such as high density polyethylene (HDPE), polyvinyl chloride resin (PVC) and polyethylene terephthalate (PET), and a multilayer material such as nylon/polyethylene (NY/PE) can be used.

A flexible liquid container which can reduce the volume after the content is discharged and empty, that is, the required space can be easily reduced, can be used. It is preferred to use the above flexible container in the present invention. As the specific example of the above flexible container, a liquid container comprising a flexible container body which is opened and closed by a cap member matching a hard opening part protruding upward from the container body, the container body and the opening part being integral-molded and having a bellows part at at least one part of the container body in the height direction (FIG. 1 and FIG. 2 disclosed in JP-A-7-5670) can be exemplified.

In the next place, a silver halide color photographic material (hereinafter sometimes referred to as merely "a photographic material") to which the composition of a color developer replenisher of the invention is applied are described below.

A silver halide color photographic material for use in the present invention comprises a support having provided thereon at least a silver halide emulsion layer containing a yellow color-forming coupler, at least a silver halide emulsion layer containing a magenta color-forming coupler, at least a silver halide emulsion layer containing a cyan color-forming coupler and, in addition to these layers, preferably at least a light-insensitive non-color-forming hydrophilic colloid layer. As such hydrophilic colloid layers, e.g., a hydrophilic colloid layer described later, an antihalation layer, an intermediate layer and a coloring layer can be exemplified.

The figures of silver halide emulsion grains for use in the present invention are not especially restricted, but cubic grains substantially having {100} planes, tetradecahedral crystal grains (apexes of these grains may be rounded, and these grains may have further higher planes), octahedral crystal grains, and tabular grains having {100} or {111} planes as main planes and an aspect ratio of 2 or more are preferably used. The aspect ratio is a value obtained by dividing the diameter of a circle having the same area with the projected area of a grain by the thickness of a grain. Cubic or tetradecahedral grains are more preferably used in the invention.

A silver halide emulsion for use in the present invention contains a silver chloride, and the silver chloride content is preferably 90 mol % or more, more preferably 93 mol % or more in view of rapid processing performance, and still more preferably 95 mol % or more.

A silver halide emulsion for use in the present invention preferably contains a silver bromide and/or a silver iodide. The silver bromide content is preferably from 0.1 to 7 mol % or more, and more preferably from 0.5 to 5 mol %, from the viewpoint of high contrast and excellent latent image stability. The silver iodide content is preferably from 0.02 to 1 mol %, more preferably from 0.05 to 0.50 mol %, and most preferably from 0.07 to 0.40 mol %, in the light of high intensity exposure, high sensitivity and high contrast.

A silver halide emulsion for use in the present invention is preferably a silver iodobromochloride emulsion, and a silver iodobromochloride emulsion having the above halogen composition is still more preferred.

It is preferred for a silver halide emulsion used in the present invention to have a silver bromide-containing phase and/or a silver iodide-containing phase. The silver bromide-containing or silver iodide-containing phase means a region where the concentration of a silver bromide or silver iodide is higher than the concentration in surroundings. Halogen compositions of a silver bromide-containing phase or a silver iodide-containing phase and surroundings may vary continuously or abruptly. Such a silver bromide-containing or silver iodide-containing phase may form a layer having almost a constant width of concentration at a certain region in a grain, or a phase may be a maximum point not having a width. The local silver bromide content of a silver bromide-containing phase is preferably 5 mol % or more, more preferably from 10 to 80 mol %, and most preferably from 15 to 50 mol %. The local silver iodide content of a silver iodide-containing phase is preferably 0.3 mol % or more, more preferably from 0.5 to 8 mol %, and most preferably from 1 to 5 mol %. A plurality of layers of silver bromide-containing or silver iodide-containing phases may be present in a grain, and the silver bromide content or silver iodide content may be different from each other, but it is necessary for a grain to have at least either one phase, preferably at least one of respective phases.

It is preferred that the silver bromide-containing phase or silver iodide-containing phase of a silver halide emulsion preferably used in the present invention be formed in a layer state so as to surround a grain. It is one preferred embodiment that a silver bromide-containing phase or silver iodide-containing phase formed in a layer state so as to surround a grain have uniform distribution of concentration in the peripheral direction of a grain in each phase. However, a maximum point or a minimum point of silver bromide or silver iodide concentration may be present in the peripheral direction of a grain and the concentration maybe distributed non-uniformly on the inside of a silver bromide-containing phase or silver iodide-containing phase formed in a layer state so as to surround a grain. For example, when a silver halide emulsion has a silver bromide-containing phase or a silver iodide-containing phase in a layer state so as to surround a grain in the vicinity of the grain surface, the concentration of silver bromide or silver iodide of the grain corners or edges may be different from that of the main planes. Further, there may be present a silver bromide-containing phase or a silver iodide-containing phase at a specific part of the surface of a grain completely isolated and not surrounding a grain, apart from a silver bromide-containing phase or a silver iodide-containing phase present in a layer state so as to surround a grain.

When a silver halide emulsion for use in the present invention contains a silver bromide-containing phase, it is preferred that the silver bromide-containing phase be formed in a layer state so as to have a maximum point of silver bromide concentration on the inside of the grain. Further, when a silver halide emulsion for use in the invention contains a silver iodide-containing phase, it is preferred that the silver iodide-containing phase be formed in a layer state so as to have a maximum point of silver bromide concentration on the surface of the grain. Such a silver bromide-containing phase or a silver iodide-containing phase is preferably composed of a silver amount of from 3 to 30% of a grain volume, and more preferably from 3 to 15%, with the intention of increasing the local concentration with a smaller amount of silver bromide or silver iodide.

A silver halide emulsion for use in the present invention preferably contains both a silver bromide-containing phase and a silver iodide-containing phase. In such a case, a silver bromide-containing phase and a silver iodide-containing phase may be present at the same part or may be present at different parts, but they are preferably present at different parts, since it makes controlling of grain formation easy. Further, a silver bromide-containing phase may contain a silver iodide-containing phase, or a silver iodide-containing phase may contain a silver bromide-containing phase. In general, an iodide added during the formation of a high silver chloride grain is liable to ooze to the surface of the grain as compared with a bromide, so that a silver iodide-containing phase is apt to be formed in the vicinity of the surface of the grain. Accordingly, when a silver bromide-containing phase and a silver iodide-containing phase are present at different parts on the inside of a grain, it is preferred to form a silver bromide-containing phase on the inner side than a silver iodide-containing phase. In such a case, another silver bromide-containing phase may be provided on the outside of the silver iodide-containing phase provided in the vicinity of the surface of the grain.

The more a silver bromide-containing phase or a silver iodide-containing phase is formed on the inside of a grain, the more increases the silver bromide amount or silver iodide amount of a silver halide emulsion preferably used in the invention. There is consequently the possibility of impairing a rapid processing performance by reducing the silver chloride content unnecessarily. Accordingly, a silver bromide-containing phase and a silver iodide-containing phase are preferably contiguous in order to aggregate the functions of controlling photographic performances in the vicinity of the surface on the inside of the grain. From these points, it is preferred to form a silver bromide-containing phase anywhere at the position of from 50 to 100% of the volume of the grain measured from the inside of the grain, and a silver iodide-containing phase anywhere at the position of from 85 to 100% of the volume of the grain. It is more preferred to form a silver bromide-containing phase anywhere at the position of from 70 to 95% of the volume of the grain and a silver iodide-containing phase anywhere at the position of from 90 to 100% of the volume of the grain.

When a silver halide emulsion preferably used in the invention contains a silver bromide or a silver iodide, a bromide ion or an iodide ion may be introduced by adding a solution of a bromide salt or an iodide salt alone, or a solution of a bromide salt or an iodide salt may be added with a solution of a silver salt and a solution of a chloride salt. In the latter case, a solution of a bromide salt or an iodide salt and a solution of a chloride salt may be added separately, or a bromide salt or an iodide salt may be added as the mixed solution with a chloride salt. A bromide salt or an iodide salt is added in the form of a soluble salt such as an alkali or an alkaline earth bromide salt or iodide salt. Alternatively, a silver bromide or a silver iodide can be added by cleaving a bromide ion or an iodide ion from an organic molecule as disclosed in U.S. Pat. No. 5,389,508. Moreover, silver bromide fine grains or silver iodide fine grains can also be used as another bromide ion or iodide ion source.

The addition of a bromide salt or iodide salt solution may be concentrated at one time of grain forming process or may be performed over a certain period of time. For obtaining an emulsion which is high sensitivity and low fog, the introduced position of an iodide ion to a high chloride emulsion is restricted. The deeper on the inside of the emulsion grain the iodide ion is introduced, the smaller is the increment of sensitivity. Accordingly, the addition of an iodide salt solution is preferably started from 50% or outer side of the volume of a grain, more preferably 70% or outer side, and most preferably 85% or outer side. Moreover, the addition of an iodide salt solution is preferably finished at 98% or inner side of the volume of a grain, and most preferably 96% or inner side. When the addition of an iodide salt solution is finished at a little inner side of the grain surface, an emulsion having higher sensitivity and lower fog can be obtained.

On the other hand, the addition of a bromide salt solution is preferably started from 50% or outer side of the volume of a grain, and more preferably 70% or outer side.

The equivalent-sphere diameter of a grain in the invention is represented by the diameter of a sphere having the same volume as the volume of the grain. A silver halide emulsion used in the present invention preferably comprises mono dispersed grains in grain size distribution.

The variation coefficient of the equivalent-sphere diameters of all the grains contained in a silver halide emulsion used in the invention is preferably 20% or less, more preferably 15% or less, and still more preferably 10% or less. The variation coefficient of the equivalent-sphere diameter is the standard deviation of equivalent-sphere diameter of each grain to the average of equivalent-sphere diameters represented by a percentage. At this time, it is preferred that monodispersed emulsions are blended and used in the same one layer or perform multilayer coating for the purpose of obtaining a broad latitude.

The grains contained in a silver halide emulsion for use in the present invention have an equivalent-sphere diameter of preferably 0.6 μm or less, more preferably 0.5 μm or less, and still more preferably 0.4 μm or less. The lower limit of the equivalent-sphere diameter of silver halide grains is preferably 0.05 μm, and more preferably 0.1 μm. A grain having an equivalent-sphere diameter of 0.6 μm corresponds to a cubic grain having a side length of about 0.48 μm, a grain having an equivalent-sphere diameter of 0.5 μm corresponds to a cubic grain having a side length of about 0.4 μm, and a grain having an equivalent-sphere diameter of 0.4 μm corresponds to a cubic grain having a side length of about 0.32 μm.

It is preferred for a silver halide emulsion which is used in the invention to contain iridium. Iridium complex is preferred as the iridium, and six-coordinate complex having six ligands with iridium as the central metal is preferred for uniformly taking into silver halide crystal. As one preferred embodiment of iridium for use in the invention, six-coordinate complex having Cl, Br or I as the ligands with Ir as the central metal is preferred, and six-coordinate complex wherein all of six ligands comprise Cl, Br or I with Ir as the central metal is more preferred. In this case, Cl, Br or I may be mixed in the six-coordinate complex. It is particularly preferred to contain six-coordinate complex having Cl, Br or I as the ligands with Ir as the central metal in a silver bromide-containing phase for the purpose of obtaining high contrast-gradation by high intensity exposure.

The specific examples of six-coordinate complexes wherein all of six ligands comprise Cl, Br or I with Ir as the central metal include $[IrCl_6]^{2-}$, $[IrCl_6]^{3-}$, $[IrBr_6]^{2-}$, $[IrBr_6]^{3-}$ and $[IrI_6]^{3-}$ can be exemplified, but the present invention is not limited thereto.

As other preferred embodiments of iridium for use in the invention, six-coordinate complexes having at least one ligand other than halogen and cyan with Ir as the central metal are preferred, six-coordinate complexes having $H_2O$, OH, O, OCN, thiazole or substituted thiazole, thiadiazole or substituted thiadiazole as the ligands with Ir as the central metal are more preferred, six-coordinate complexes having at least one ligand selected from $H_2O$, OH, O, OCN, thiazole or substituted thiazole, the remainder of the ligands being Cl, Br or I with Ir as the central metal are still more preferred, and six-coordinate complexes having one or two ligands selected from 5-methylthiazole, 2-chloro-5-fluorothiadiazole and 2-bromo-5-fluorothiadiazole, the remainder of the ligands being Cl, Br or I with Ir as the central metal are most preferred.

As the specific examples of six-coordinate complexes having at least one ligand selected from $H_2O$, OH, O, OCN, thiazole or substituted thiazole, the remainder of the ligands being Cl, Br or I with Ir as the central metal, $[Ir(H_2O)Cl_5]^{2-}$, $[Ir(OH)Br_5]^{3-}$, $[Ir(OCN)Cl_5]^{3-}$, $[Ir(thiazole)Cl_5]^{2-}$, $[Ir(5\text{-methylthiazole})Cl_5]^{2-}$, $[Ir(2\text{-chloro-5-fluoro-thiadiazole})Cl_5]^{2-}$, and $[Ir(2\text{-bromo-5-fluorothiadiazole})Cl_5]^{2-}$ are exemplified, but the present invention should not be construed as being limited thereto.

In addition to the above iridium complexes, it is preferred for a silver halide emulsion for use in the present invention to contain six-coordinate complexes having CN as the ligands with Fe, Ru, Re or Os as the central metal, e.g., $[Fe(CN)_6]^{4-}$, $[Fe(CN)_6]^{3-}$, $[Ru(CN)_6]^{4-}$, $[Re(CN)_6]^{4-}$ and $[Os(CN)_6]^{4-}$. It is further preferred for a silver halide emulsion for use in the invention to contain pentachloronitrosyl complex or pentachlorothionitrosyl complex with Ru, Re or Os as the central metal, and six-coordinate complex having Cl, Br or I as the ligands with Rh as the central metal. These ligand may be subjected to partial aquation.

The above-described metal complexes are anions, and when salts are formed with cations, those easily soluble in water as the counter cations thereof are preferred. Specifically, alkali metal ions, e.g., a sodium ion, a potassium ion, a rubidium ion, a cesium ion and a lithium ion, an ammonium ion and an alkylammonium ion are preferred. These metal complexes can be used by being dissolved in water and appropriate organic solvents miscible with water (e.g., alcohols, ethers, glycols, ketones, esters, amides). The optimal amount of these metal complexes varies depending upon the kind, but they are preferably added in an amount of from $1\times10^{-10}$ to $1\times10^{-3}$ mol, and most preferably from $1\times10^{-9}$ to $1\times10^{-5}$ mol.

It is preferred to incorporate these metal complexes into a silver halide grain by directly adding them to a reaction solution at the time when silver halide grains are formed, or adding the metal complexes to a halide aqueous solution or other solution for forming silver halide grains, and adding the solution to a grain-forming reaction solution. It is also preferred that a fine grain having incorporated therein the metal complexes in advance is subjected to physical ripening, to thereby incorporate the metal complexes into a silver halide grain. Further, these methods may be used in combination to incorporate the complexes into a silver halide grain.

When these complexes are incorporated into a silver halide grain, they may be present uniformly on the inside of a silver halide grain but, as disclosed in JP-A-4-208936, JP-A-2-125245 and JP-A-3-188437, it is preferred that they are localized only on the surface layer of a grain, or it is also preferred that the complexes are present only on the inside of a grain and a layer not containing the complexes is provided on the surface of a grain. As disclosed in U.S. Pat. Nos. 5,252,451 and 5,256,530, it is also preferred that fine grains having incorporated the complexes are subjected to physical ripening to thereby modify the grain surfaces. These methods can be used in combination, and a plurality of complexes may be incorporated into one silver halide grain. The halogen composition of the position into which the above complexes are incorporated is not particularly restricted, but it is preferred that six-coordinate complex wherein all of six ligands comprise Cl, Br or I with Ir as the central metal be contained in a maximum point of silver bromide concentration.

A silver halide emulsion for use in the present invention is generally chemically sensitized. With respect to chemical sensitization methods, sulfur sensitization represented by the addition of labile sulfur compounds, noble metal sensitization represented by gold sensitization, or reduction sensitization can be used alone or in combination. The compounds disclosed in JP-A-62-215272, right lower column, p. 18 to right upper column, p. 22are preferably used in chemical sensitization. A silver halide emulsion subjected to gold sensitization is particularly preferably used in the present invention, since the fluctuation in photographic performances can be lessened by undergoing gold sensitization when a photographic material is subjected to scanning exposure with laser beams and the like.

For subjecting a silver halide emulsion to gold sensitization, various kinds of inorganic gold compounds, gold(I) complexes having inorganic ligands and gold(I) compounds having organic ligands can be used. As the inorganic gold compounds, e.g., chloroauric acid and its salts, as the gold(I) complexes having inorganic ligands, e.g., dithiocyanatoaurate compounds such as potassium dithiocyanatoaurate(I), and dithiosulfatoaurate compounds such as trisodium dithiosulfatoaurate(I) can be used.

As the gold(I) compounds having organic ligands (organic compounds), bis-gold(I) mesoionic heterocyclic rings, e.g., bis(1,4,5-trimethyl-1,2,4-triazolium-3-thiolato) aurate(I) tetrafluoroborate disclosed in JP-A-4-267249, organic mercapto gold(I) complex, e.g., potassium bis{1-[3-(2-sulfonatobenzamido)phenyl]-5-mercaptotetrazole potassium salt}aurate(I) pentahydrate disclosed in JP-A-11-218870, and gold(I) compounds coordinated with nitrogen compound anions, e.g., sodium bis(1-methylhydantoinato) aurate(I) tetrahydrate disclosed in JP-A-4-268550 can be used. A gold(I) compound having organic ligands may be synthesized in advance and then isolated, or a gold(I) compound having organic ligands may be generated by mixing organic ligands and a gold compound (chloroauric acid or the salts thereof) and adding the mixture to an emulsion without isolation. Further, a gold(I) compound having organic ligands may be generated in an emulsion by separately adding organic ligands and a gold compound (chloroauric acid or the salts thereof) to an emulsion.

Further, the gold(I) thiolate compounds disclosed in U.S. Pat. No. 3,503,749, the gold compounds disclosed in JP-A-8-69074,. JP-A-8-69075 and JP-A-9-269554, and the compounds disclosed in U.S. Pat. Nos. 5,620,841, 5,912,112, 5,620,841, 5,939,245 and 5,192,111 can also be used.; The addition amount of these compounds covers a wide range according to purposes, and is generally from $5\times10^{-7}$ to $5\times10^{-3}$ mol, and preferably from $5\times10^{-6}$ to $5\times10^{-4}$ mol, per mol of the silver halide.

It is also possible to use colloidal gold sulfide, and the producing method of colloidal gold sulfide is described in *Research Disclosure*, No. 37154, *Solid State Ionics*, Vol. 79, pp. 60 to 66 (1995), and *Compt. Rend. Hebt. Seances, Acad. Sci. Sect. B*, Vol. 263, p. 1328 (1966). The addition amount of colloidal gold sulfides covers a wide range according to purposes, and is generally from $5\times10^{-7}$ to $5\times10^{-3}$ mol, and preferably from $5\times10^{-6}$ to $5\times10^{-4}$ mol, in terms of gold atoms, per mol of the silver halide.

Chalcogen sensitization can be performed together with gold sensitization in the same molecule. Molecules which can release $AuCh^-$ can be used. Here, Au represents Au(I) and Ch represents a sulfur atom, a selenium atom or a tellurium atom. As the molecules which can release $AuCh^-$, e.g., gold compounds represented by AuCh-L are exemplified. Here, L represents atomic groups which constitute molecules by bonding to AuCh. Further one or more ligands may be coordinated to Au besides Ch-L. The specific examples of such compounds include Au(I) salt of thiosugar (e.g., Au-thioglucose such as α-Au-thioglucose, Au-peracetylthioglucose, Au-thiomannose, Au-thiogalactose, and Au-thioarabinose), Au(I) salt of selenosugar (e.g., Au-peracetylselenoglucose and Au-peracetylselenomannose), and Au(I) salt of tellurosugar. Thiosugar, selenosugar and tellurosugar are compounds in which the hydroxyl group at anomer-position of the sugar is substituted with an SH group, an SeH group and a TeH group respectively. The addition amount of these compounds covers a wide range according to purposes, and is generally from $5\times10^{-7}$ to $5\times10^{-3}$ mol, and preferably from $3\times10^{-6}$ to $3\times10^{-4}$ mol, per mol of the silver halide.

Various sensitization methods can be used in combination with gold sensitization for a silver halide emulsion for use in the invention, e.g., sulfur sensitization, selenium sensitization, tellurium sensitization, reduction sensitization, or noble metal sensitization using noble metals other than gold compounds can be combined. The combination of gold sensitization with sulfur sensitization or selenium sensitization is particularly preferred.

Various compounds and the precursors of these compounds can be added to a silver halide emulsion for use in the invention for the purpose of preventing the generation of fog or stabilizing the photographic performances during the production, storage or photographic processing of the photographic material. The compounds disclosed in JP-A-62-215272, pp. 39 to 72 can be preferably used in the present invention. The 5-arylamino-1,2,3,4-thiatriazole compound (the aryl residue has at least one electron attracting group) disclosed in EP 0447647 is also preferably used.

For increasing the storage stability of a silver halide emulsion, various compounds can be preferably used in the present invention, e.g., the hydroxamic acid derivatives disclosed in JP-A-11-109576, the cyclic ketones having double bonds substituted with an amino group or a hydroxyl group at both terminals contiguous to carbonyl groups disclosed in JP-A-11-327094 (in particular, the compound represented by formula (S1) is preferred and the specific examples shown in paragraphs 0036 to 0071 of the same patent can be used in the invention), the sulfo-substituted catechols and hydroquinones disclosed in JP-A-11-143011 (e.g., 4,5-dihydroxy-1,3-benzene-disulfonic acid, 2,5-dihydroxy-1,4-benzenedisulfonic acid, 3,4-dihydroxybenzenesulfonic acid, 2,3-dihydroxybenzenesulfonic acid, 2,5-dihydroxybenzenesulfonic acid, 3,4,5-trihydroxybenzenesulfonic acid, and salts of these compounds), the hydroxylamines represented by formula (A) disclosed in U.S. Pat. No. 5,556,741, (the specific examples shown in the 4th column, line 56 to 11th column, line 22 of the same patent are preferably applied to the invention and used in the invention), and the water-soluble reducing agents represented by formulae (I) to (III) disclosed in JP-A-11-102045 are preferably used in the present invention.

A silver halide emulsion for use in the invention can contain a spectral sensitizing dye for the purpose of showing sensitivity to a desired wavelength range of light, i.e., for imparting spectral sensitivity. As the spectral sensitizing dyes for use in the spectral sensitization of the blue, green and red regions, the compounds described, e.g., in F. M. Harmer, *Heterocyclic Compounds—Cyanine Dyes and Related Compounds,* John Wiley & Sons, New York, London (1964) are exemplified. The compounds and spectral sensitizing methods disclosed in JP-A-62-215272, right upper column, page 22 to page 38 are preferably used in the invention. Further, as the red-sensitive spectral sensitizing dye for silver halide emulsion grains having a high silver chloride content, the spectral sensitizing dyes disclosed in JP-A-3-123340 are very preferably used from the viewpoint of stability, adsorption strength and the temperature dependency of exposure.

The addition amount of these spectral sensitizing dyes covers a wide range according to purposes, and is preferably from $0.5\times10^{-6}$ to $1.0\times10^{-2}$ mol, and more preferably from $1.0\times10^{-6}$ to $5.0\times10^{-3}$ mol, per mol of the silver halide.

It is preferred for the photographic material of the present invention to contain dyes which are decolorable by processing (above all, an oxonol dye and a cyanine dye) as disclosed in EP-A-0337490, pp.27 to 76 in a hydrophilic colloid layer for the purpose of preventing irradiation and halation and improving safelight safety. Further, the dyes disclosed in EP 0819977 are also preferably used in the present invention. Some of these water-soluble dyes worsen color separation and safelight safety when the use amount is increased. As the dyes which can be used without worsening color separation, the water-soluble dyes disclosed in JP-A-5-127324, JP-A-5-127325 and JP-A-5-216185 are preferred.

The silver halide color photographic material of the present invention is preferably a reflex silver halide color photographic material and particularly preferably a color photographic paper.

As supports for use in the present invention, a reflex support and a transparent support are exemplified.

With respect to reflex supports, silver halide emulsions, the kinds of dissimilar metal ions which are doped in silver halide grains, storage stabilizers and antifoggants for silver halide emulsions, chemical sensitization methods (sensitizers), spectral sensitization methods (spectral sensitizers), cyan, magenta and yellow couplers and the emulsifying dispersion methods of these couplers, color image storage improvers (antistaining agents and discoloration inhibitors), dyes (coloring layers), kinds of gelatins, the layer constitutions of photographic materials, and pH of the coated layers of photographic materials, those disclosed in the patents summarized in the following table can be particularly preferably used in the present invention.

| Photographic Constitutional Element | JP-A-7-104448 | JP-A-7-77775 | JP-A-7-301895 |
|---|---|---|---|
| Reflex support | column 7, line 12 to column 12, line 19 | column 35, line 43 to column 44, line 1 | column 5, line 40 to column 9, line 26 |
| Silver halide emulsion | column 72, line 29 to column 74, line 18 | column 44, line 36 to column 46, line 29 | column 77, line 48 to column 80, line 28 |
| Kind of dissimilar metal ion | column 74, line 19 to the same column, line 44 | column 46, line 30 to column 47, line 5 | column 80, line 29 to column 81, line 6 |
| Storage stabilizer antifoggant | column 75, line 9 to the same column, line 18 | column 47, line 20 to the same column, line 29 | column 18, line 11 to column and 31, line 37 (in particular, mercapto heterocyclic compound) |
| Chemical sensitizing method (chemical sensitizer) | column 74, line 45 to column 75, line 6 | column 47, line 7 to the same column, line 17 | column 81, line 9 to the same column, line 17 |
| Spectral sensitizing method (spectral sensitizer) | column 75, line 19 to column 76, line 45 | column 47, line 30 to column 49, line 6 | column 81, line 21 to column 82, line 48 |
| Cyan coupler | column 12, line 20 to column 39, line 49 | column 62, line 50 to column 63, line 16 | column 88, line 49 to column 89, line 16 |
| Yellow coupler | column 87, line 40 to column 88, line 3 | column 63, line 17 to the same column, line 30 | column 89, line 17 to the same column, line 30 |

| Photographic Constitutional Element | JP-A-7-104448 | JP-A-7-77775 | JP-A-7-301895 |
|---|---|---|---|
| Magenta coupler | column 88, line 4 to the same column, line 18 | column 63, line 3 to column 64, line 11 | column 31, line 34 to column 77, line 44; column 88, line 32 to the same column, line 46 |
| Emulsifying dispersion method of coupler | column 71, line 3 to column 72, line 11 | column 61, line 36 to the same column, line 49 | column 87, line 35 to the same column, line 48 |
| Color image storage improver (antistaining agent) | column 39, line 50 to column 70, line 9 | column 61, line 50 to column 62, line 49 | column 87, line 49 to column 88, line 48 |
| Discoloration inhibitor | column 70, line 10 to column 71, line 2 | — | — |
| Dye (coloring layer) | column 77, line 42 to column 78, line 41 | column 7, line 14 to column 19, line 42; column 50, line 3 to column 51, line 14 | column 9, line 27 to column 18, line 10 |
| Kind of gelatin | column 78, line 42 to the same column, line 48 | column 51, line 15 to the same column, line 20 | column 83, line 13 to the same column, line 19 |
| Layer constitution of photographic material | column 39, line 11 to the same column, line 26 | column 44, line 2 to the same column, line 35 | column 31, line 38 to column 32, line 33 |
| pH of coated layer of photographic material | column 72, line 12 to the same column, line 28 | — | — |
| Scanning exposure | column 76, line 6 to column 77, line 41 | column 49, line 7 to column 50, line 2 | column 82, line 49 to column 83, line 12 |
| Preservative in developing solution | column 88, line 19 to column 89, line 22 | — | — |

In addition to the cyan, magenta and yellow couplers described in the above table, the cyan, magenta and yellow couplers disclosed in JP-A-62-215272, line 4, right upper column, page 91 to line 6, left upper column, page 121; JP-A-2-33144, line 14, right upper column, page 3 to the last line, left upper column, page 18; JP-A-2-33144, line 6, right upper column, page 30 to line 11, right lower column, page 35; and EP-A-355660, lines 15 to 27, page 4; line 30, page 5 to the last line, page 28; lines 29 to 31, page 45; and line 23, page 47 to line 50, page 63 are also preferably used in the present invention.

The compounds represented by formulae (II) and (III) disclosed in WO 98/33760, and the compound represented by formula (D) disclosed in JP-A-10-221825 may also be preferably used in the present invention.

Pyrrolotriazole couplers are preferably used as cyan dye-forming couplers (hereinafter sometimes simply referred to as "cyan couplers") in the present invention, and the coupler represented by formula (I) or (II) in JP-A-5-313324, the coupler represented by formula (I) in JP-A-6-347960, and the couplers exemplified in these patents are particularly preferably used. Phenol-based and naphthol-based cyan couplers are also preferably used in the present invention, e.g., the cyan coupler represented by formula (ADF) in JP-A-10-333297 is preferred. Besides the above-described cyan couplers, the pyrroloazole type cyan couplers disclosed in EP 0488248 and EP-A-0491197, the 2,5-diacylaminophenol couplers disclosed in U.S. Pat. No. 5,888,716, the pyrazoloazole type cyan couplers having an electron attractive group at the 6-position and a hydrogen bonding group disclosed in U.S. Pat. Nos. 4,873,183and 4,916,051, in particular, the pyrazoloazole type cyan couplers having a carbamoyl group at the 6-position disclosed in JP-A-8-171185, JP-A-8-311360 and JP-A-8-339060 are also preferred.

In addition to the diphenylimidazole-based cyan couplers disclosed in JP-A-2-33144, the 3-hydroxypyridine-based cyan couplers disclosed in EP-A-0333185 (above all, Coupler (42), a 4-equivalent coupler which is rendered 2-equivalent by having a chlorine releasing group, and Couplers (6) and (9) are particularly preferred), the cyclic active methylene-based cyan couplers disclosed in JP-A-64-32260 (above all, Couplers 3, 8 and 34 exemplified as specific examples are particularly preferred), the pyrrolopyrazole type cyan couplers disclosed in EP-A-0456226, and the pyrroloimidazole type cyan couplers disclosed in EP 0484909 can also be used.

Of cyan couplers, the pyrroloazole-based cyan coupler represented by formula (I) disclosed in JP-A-11-282138 is particularly preferred, and the description in the paragraphs [0012] to [0059] of the same patent including exemplified Cyan Couplers (1) to (47) can be applied to the present invention in their entirety and preferably taken in as a part of the specification of the invention.

The 5-pyrazolone-based magenta couplers and the pyrazoloazole-based magenta couplers disclosed in the patents cited in the above table are used as magenta dye-forming couplers (hereinafter sometimes simply referred to as "magenta couplers") in the present invention. Above all, in the points of hue, image stability and a coloring property, the pyrazolotriazole couplers to which a secondary or tertiary alkyl group is directly bonded at the 2-, 3- or 6-position of the pyrazolotriazole ring disclosed in JP-A-61-65245, the pyrazoloazole couplers containing a sulfonamido group in the molecule disclosed in JP-A-61-65246, the pyrazoloazole couplers having an alkoxyphenylsulfonamido ballast group disclosed in JP-A-61-147254, and the pyrazoloazole couplers having an alkoxy group or an aryloxy group at the 6-position disclosed in EP-A-226849and EP-A-294785are preferably used. In particular, the pyrazoloazole coupler represented by formula (M-I) disclosed in JP-A-8-122984 is preferred as a magenta coupler, and the description in the paragraphs [0009] to [0026] of the same patent can be applied to the present invention in their entirety and taken in as a part of the specification of the invention. In addition to the above, the pyrazoloazole couplers having steric hindrance groups at both of the 3- and 6-positions disclosed in EP 854384 and EP 884640 are also preferably used.

The following compounds can be used as yellow dye-forming couplers (hereinafter sometimes simply referred to as "yellow couplers") in the photographic material according to the present invention, if necessary. That is, the acylacetamide type yellow couplers in which the acyl group has a 3- to 5-membered cyclic structure disclosed in EP-A-0447969, the malondianilide type yellow couplers having a cyclic structure disclosed in EP-A-0482552, the pyrrole-2 (or -3)-yl- or indole-2(or -3)-yl-carbonylacetanilide-based couplers disclosed in EP-A-953870, EP-A-953871, EP-A-953872, EP-A-953873, EP-A-953874 and EP-A-953875, and the acylacetamide type yellow couplers having a dioxane structure disclosed in U.S. Pat. No. 5,118,599 are preferably used. Of these, the acylacetamide type yellow couplers in which the acyl group is a 1-alkylcyclopropane-1-carbonyl group and the malondianilide type yellow couplers in which one anilide constitutes an indoline ring are preferably used. These couplers may be used alone or in combination.

It is preferred that the couplers for use in the present invention be impregnated with a loadable latex polymer (e.g., one disclosed in U.S. Pat. No. 4,203,716) in the presence (or absence) of the high boiling point organic solvents described in the above table, or the couplers are dissolved in a polymer insoluble in water but soluble in an organic solvent and then dispersed in a hydrophilic colloidal aqueous solution in an emulsified state. The examples of the polymers insoluble in water but soluble in an organic solvent which can preferably be used in the invention include the homopolymers and copolymers disclosed in U.S. Pat. No. 4,857,449, from columns 7 to 15, and WO 88/00723, pp. 12 to 30. Methacrylate-based or acrylamide-based polymers are more preferred, and acrylamide-based polymers are particularly preferred in view of color image stability.

Well-known color mixing preventives can be used in the present invention, and the compounds disclosed in the following patents are particularly preferred.

For example, the high molecular weight redox compounds disclosed in JP-A-5-333501, the phenidone and hydrazine compounds disclosed in WO 98/33760 and U.S. Pat. No. 4,923,787, and the white couplers disclosed in JP-A-5-249637, JP-A-10-282615 and German Patent-A-19,629,142 can be used. Further, when rapid development is performed with increasing pH of a developing solution, the redox compounds disclosed in German Patent-A-19,618,786, EP-A-839623, EP-A-842975, German Patent-A-19,806,846 and French Patent-A-276,046 are also preferably used.

It is preferred in the present invention to use a compound having a triazine skeleton having a high molecular extinction coefficient as the ultraviolet absorber, and the compounds disclosed in the following patents can be used. These compounds are preferably added to a light-sensitive layer and/or a light-insensitive layer. For example, the compounds disclosed in JP-A-46-3335, JP-A-55-152776, JP-A-5-197074, JP-A-5-232630, JP-A-5-307232, JP-A-6-211813, JP-A-8-53427, JP-A-8-234364, JP-A-8-239368, JP-A-9-31067, JP-A-10-115898, JP-A-10-147577, JP-A-10-182621, German Patent-A-19,739,797, EP-A-711804 and JP-T-8-501291 (the term "JP-T" as used herein means a published Japanese translation of a PCT patent application) can be used.

It is preferred to use gelatin as the binder or the protective colloid in the photographic material according to the present invention, but other hydrophilic colloids can be used alone or in combination with gelatin. As preferred gelatins, the content of heavy metals such as iron, copper, zinc, and manganese, which are contained as impurities, is preferably 5 ppm or less, and more preferably 3 ppm or less. The amount of calcium contained in the photographic material is preferably 20 mg/m$^2$ or less, more preferably 10 mg/m$^2$ or less, and most preferably 5 mg/m$^2$ or less.

The antibacterial agents and antifungal agents disclosed in JP-A-63-271247 are preferably used in the present invention for preventing various kinds of molds and bacteria from proliferating in hydrophilic colloid layers and deteriorating images. The pH of the layers of the photographic material is preferably from 4.0 to 7.0, and more preferably from 4.0 to 6.5.

Surfactants can be added to a photographic material in the present invention for the purpose of improving coating stability of a photographic material, preventing the generation of static electricity and adjusting the quantity of electrification. The examples of the surfactants which can be used include anionic surfactants, cationic surfactants, betaine surfactants and nonionic surfactants, e.g., those disclosed in JP-A-5-333492 can be exemplified. Fluorine-containing surfactants are preferably used in the present invention. Fluorine-containing surfactants are particularly preferably used in the present invention. These fluorine-containing surfactants may be used alone or may be used in combination with conventionally well-known other surfactants, preferably with conventionally well-known other surfactants. The addition amount of these surfactants is not particularly restricted and the amount is generally from $1\times10^{-5}$ to 1 g/m$^2$, preferably from $1\times10^{-4}$ to $1\times10^{-1}$ g/m$^2$, and more preferably from $1\times10^{-3}$ to $1\times10^{-2}$ g/m$^2$.

The photographic material of the invention can form an image through two processes of exposure process of irradiating the material with light according to image data, and development process of developing the exposed material.

The photographic material of the invention is suitable for a scanning exposure system using a cathode ray tube (CRT) as well as preferably used in a printing system using a general negative printer. A cathode ray tube exposure apparatus is simple and compact as compared with the apparatus using laser beams, costs can be saved and the adjustment of optical axis and color can be easily carried out. Various emitters showing emission to spectral regions according to necessity are used in a cathode ray tube for image exposure. For example, any one of red emitter, green emitter and blue emitter, or mixture of two or more of these emitters are used. Spectral regions are not limited to the above red, green and blue, and phosphors emitting lights in yellow, orange, violet and infrared regions are also used. A cathode ray tube which emits white light by mixing these emitters is often used.

When a photographic material has a plurality of photosensitive layers having different spectral sensitivity distributions and a cathode ray tube also has phosphors emitting lights in a plurality of spectral regions, a plurality of colors may be irradiated at the same time, i.e., image signals of a plurality of colors may be inputted to the cathode ray tube and emitted from the tube. Alternatively, an exposure method comprising inputting an image signal of each color in order and emitting light of each color in order through a filter cutting other colors except for that color (sequential face exposure) may be adopted. In general, sequential face exposure is preferred for obtaining a high quality image, since a cathode ray tube having high resolving power can be used.

The photographic material of the present invention can be used in a digital scanning exposure system using monochromatic high density light, such as a gas laser, a light emitting diode, a semiconductor laser, a second harmonic generation light source (SHG) comprising a combination of nonlinear optical crystal with a semiconductor laser or a solid state laser using a semiconductor laser as an excitation light source. For obtaining a compact and inexpensive system, it is preferred to use a semiconductor laser, or a second harmonic generation light source (SHG) comprising a combination of a semiconductor laser or a solid state laser with nonlinear optical crystal. In particular, for designing a compact and inexpensive apparatus having a longer duration of life and high stability, it is preferred to use a semiconductor laser, and at least one of exposure light sources should be a semiconductor laser.

When such a scanning exposure light source is used, the spectral sensitivity maximum wavelength of the photographic material of the present invention can be set arbitrarily according to the wavelength of the scanning exposure light source to be used. Since the oscillation wavelength of a laser can be made half by using an SHG light source comprising a combination of nonlinear optical crystal with a solid state laser using a semiconductor laser as an excitation light source or a semiconductor laser, blue light and green light can be obtained. Accordingly, it is possible to have the spectral sensitivity maximum of a photographic material in normal three regions of blue, green and red. The exposure time in such a scanning exposure is defined as the time necessary to expose a pixel size with the pixel density being 400 dpi, and preferred exposure time is $10^{-4}$ sec or less and more preferably $10^{-6}$ sec or less.

The silver halide color photographic material according to the present invention can be preferably used in combination with the exposure and development systems described in the following patents. These development systems include the automatic printing and the developing system disclosed in JP-A-10-333253, the transporting apparatus of a photographic material disclosed in JP-A-2000-10206, the recording system including an image reader disclosed in JP-A-11-215312, the exposure systems comprising a color image-recording system disclosed in JP-A-11-88619 and JP-A-10-202950, the digital photo print system including a remote diagnostic system disclosed in JP-A-10-210206, and the photo print system including an image-recording apparatus disclosed in Japanese Patent Application No. 10-159187.

The scanning exposure methods preferably applicable to the invention are disclosed in detail in the patent specifications described in the above table.

When the photographic material of the present invention is subjected to an exposure by printer, the band stop filter disclosed in U.S. Pat. No. 4,880,726 is preferably used. Using this filter, color mixing of light can be eliminated and color reproducibility is remarkably improved.

The photographic material of the present invention may be subjected to pre-exposure of yellow micro dot pattern to restrict copying before image data are given as disclosed in EP-A-0789270 and EP-A-0789480.

EXAMPLES

Example 1

Preparation of Concentrated Composition of Color Developer Replenisher

Concentrated composition of color developer replenishers #1 to #5 each having the composition shown in Table 1 below were prepared. Each amount in Table 1 is a prescription value per one liter of the composition. The abbreviations CBS, DSHA, PTS.Na and TIPA means m-carboxybenzenesulfinic acid, disulfoethylhydroxylamine, sodium p-toluenesulfonate, and triisopropanolamine respectively, and the developing agent is 4-amino-3-methyl-N-ethyl-N-(β-methanesulfonamidoethylanilin e sesquisulfate monohydrate.

TABLE 1

| | #1 | #2 | #3 | #4 | #5 |
|---|---|---|---|---|---|
| KOH | 20 g | 40 g | 40 g | 20 g | 40 g |
| NaOH | 22 g | 25 g | 25 g | 25 g | 25 g |
| EDTA | 20 g | 20 g | 20 g | 20 g | 20 g |
| Tiron | 2 g | 2 g | 2 g | 2 g | 2 g |
| Sodium sulfite | 1 g | 1 g | 1 g | 1 g | 1 g |
| CBS | 15 g | 15 g | 15 g | 15 g | 15 g |

TABLE 1-continued

| | #1 | #2 | #3 | #4 | #5 |
|---|---|---|---|---|---|
| DSHA | 50 g | 50 g | 50 g | 50 g | 50 g |
| PTS · Na | 0.28 mol | 0.28 mol | — | 0.28 mol | — |
| ϵ-Caprolactam | — | — | — | — | 0.28 mol |
| Developing agent | 0.12 mol | 0.154 mol | 0.154 mol | 0.154 mol | 0.154 mol |
| Potassium carbonate | 100 g | 100 g | 100 g | 100 g | 100 g |
| TIPA | 30 g | 30 g | — | — | — |
| pH | 13.20 Comparison | 13.40 Comparison | 13.40 Comparison | 13.40 Invention | 13.40 Invention |

pH was adjusted with KOH and a sulfuric acid.

Evaluation of Concentrated Composition

The stability of concentrated composition, the suppressing property of creeping over of a developer replenisher and photographic performances were evaluated with the prepared concentrated compositions #1 to #5 as described below.

Stability of Concentrated Composition

The samples prepared, each 500 ml, were put in a HDPE bottle having a capacity of 600 ml, stopped the bottle and stored at 0° C. for two weeks. Each sample was taken out after two weeks and the presence of precipitates and the turbidity of the solution were visually observed. The results obtained are shown in Table 2.

Suppressing Property Creeping Over of Developer Replenisher

Each 260 ml of the above concentrated compositions #1 to #5 was diluted with water to make one liter (diluted 3.84 times) of a developer replenisher. One liter of each replenisher was put in a rigid vinyl chloride resin vessel of a square having inside measure at bottom of 10 cm×10 cm and a height of 15 cm, and a floating lid of an expanded vinyl chloride resin having dimensions of 9.7 mm×9.7 mm and a thickness of 3 mm was floated on the liquid, to thereby reduce the open area. This was the simulation of the developer replenisher tank. The replenisher was stored for two weeks at room temperature (from about 20 to 25° C.) in this state, and the presence of precipitates around the floating lid after storage was visually observed. The results obtained are shown in Table 2.

<Photographic Performances>

1. Preparation of Photographic Material Samples

Photographic materials for use in continuous processing test were prepared as follows.

Preparation of Emulsion A for Blue-Sensitive Layer

After adding 46.3 ml of a 10% NaCl solution, 46.4 ml of $H_2SO_4$ (1N), and 0.012 g of a compound represented by formula (X) shown below to 1.06 liters of deionized distilled water containing 5.7 mass % of deionized gelatin, the liquid temperature was adjusted to 60° C., and immediately after that 0.1 mol of silver nitrate and 0.1 mol of NaCl were added to the reaction vessel over 10 minutes while stirring the reaction solution at high speed. Subsequently, a solution containing 1.5 mol of silver nitrate and NaCl was added thereto over 60 minutes by an accelerating flow rate so that the final addition rate became 4 times the initial addition rate. In the next place, a solution containing 0.2 mol % of silver nitrate and NaCl was added thereto at a constant flow rate over 6 minutes. At this time, $5\times10^{-7}$ mol of $K_3IrCl_5(H_2O)$ based on the total silver amount was added to the NaCl solution, thereby aquo-iridium was doped in the grains.

Further, 0.2 mol of silver nitrate, 0.18 mol of NaCl and 0.02 mol of KBr were added to the reaction solution over 6 minutes. At this time, $K_4Ru(CN)_6$ and $K_4Fe(CN)_6$ equivalent to $0.5\times10^{-5}$ mol based on the total silver amount were dissolved and added to silver halide grains.

Further, during the final stage of grain growth, an aqueous solution of KI equivalent to 0.001 mol based on the total silver amount was added to the reaction vessel over 1 minute. The addition was started at the point of time of 93% of the total grain formation had finished.

After that, a precipitant of Compound (Y) was added to the reaction vessel at 40° C. to adjust pH to near 3.5, and the reaction solution was desalted and washed.

Compound (X)

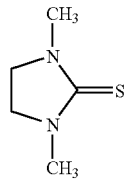

Compound (Y)

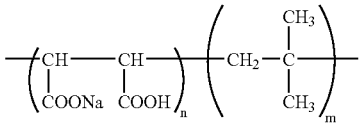

n and m each represents an integer

Deionized gelatin, an NaCl aqueous solution and an NaOH aqueous solution were added to the desalted and washed emulsion, the temperature was raised to 50° C., and pAg and pH were adjusted to 7.6 and 5.6 respectively.

Thus, gelatin containing cubic silver halide grains comprising halogen composition of 98.9 mol % of silver chloride, 1 mol % of silver bromide, and 0.1 mol % of silver iodide and having an average side length of 0.70 μm and the variation coefficient of side length of 8% was obtained.

While maintaining the obtained emulsion grains at 60° C., $2.5\times10^{-4}$ mol/mol Ag of Spectral Sensitizing Dye-1 and $2.0\times10^{-4}$ mol/mol Ag of Spectral Sensitizing Dye-2 were added thereto. To the emulsion were added $1\times10^{-5}$ mol/mol Ag of Thiosulfonic Acid Compound-1, and then a fine grain emulsion comprising 90 mol % of silver bromide and 10 mol % of silver chloride having an average grain size of 0.05 μm doped with iridium hexachloride, and the emulsion was subjected to ripening for 10 minutes. Further, fine grains comprising 40 mol % of silver bromide and 60 mol % of silver chloride having an average grain size of 0.05 μm were added, and the emulsion was subjected to ripening for 10 minutes. The fine grains were dissolved, by which the silver bromide content of the cubic host grains increased to 1.3 mol. Iridium hexachloride was doped in an amount of $1\times10^{-7}$ mol/mol Ag.

Subsequently, $1\times10^{-5}$ mol/mol Ag of sodium thiosulfate and $2\times10^{-5}$ mol of Gold Sensitizer-1 were added to the emulsion. The temperature was immediately raised to 60° C., followed by ripening for 40 minutes, and then the temperature was lowered to 50° C. Just after temperature was lowered, Mercapto Compound-1 and Compound-2 were added each in an amount of $6\times10^{-4}$ mol/mol Ag. After the emulsion was ripened for 10 minutes, an aqueous solution of KBr was added thereto in an amount of 0.008 mol based on the silver, and the emulsion was reaped after ripening for further 10 minutes and lowering the temperature.

Thus, high sensitivity Emulsion A-1 was obtained.

Cubic grains having an average side length of 0.55 μm and the variation coefficient of the side length of 9% were formed in the same manner as the producing method of the above emulsion except for changing the temperature during grain formation to 55° C.

Spectral sensitization and chemical sensitization were performed according to the amount to compensate for the coincidence of the specific surface area (side length ratio: 0.7/0.55=1.27 times). Thus, low sensitivity Emulsion A-2 was prepared.

Spectral Sensitizing Dye-1

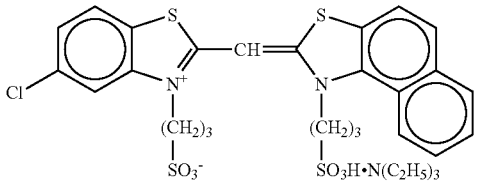

Spectral Sensitizing Dye-2

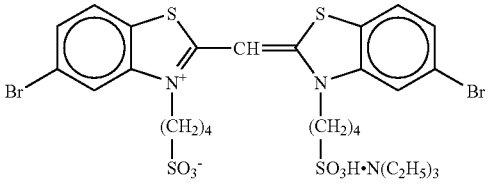

Thiosulfonic Acid Compound-1

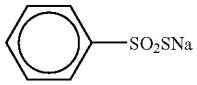

Mercapto Compound-1

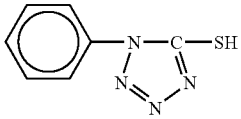

Mercapto Compound-2

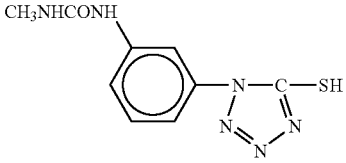

Gold Sensitizer-1

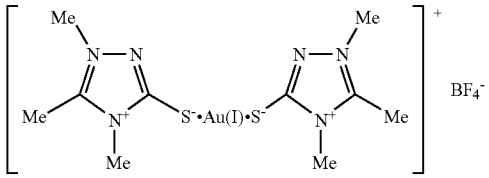

Preparation of Emulsion C for Green-Sensitive Layer

Green-sensitive high sensitivity Emulsion C-1 and low sensitivity Emulsion C-2 were prepared in the same manner as the preparing methods of Emulsions A-1 and A-2 respectively except for lowering the temperature in the grain formation of Emulsion A-1 and changing the kinds of the sensitizing dyes to the following dyes.

Sensitizing Dye D

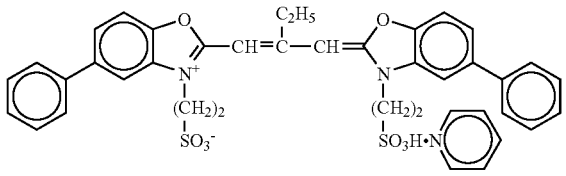

Sensitizing Dye E

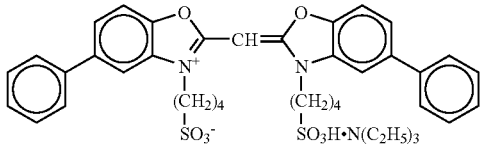

The average side length of the high sensitivity emulsion grains was 0.40 μm, and that of the low sensitivity emulsion grains was 0.30 μm. The variation coefficient of the side length was 8% in both emulsions.

Sensitizing Dye D was added to the large grain size emulsion in an amount of $3.0\times10^{-4}$ mol, and to the small grain size emulsion in an amount of $3.6\times10^{-4}$ mol. each per mol of the silver halide, and Sensitizing Dye E was added to the large grain size emulsion in an amount of $4.0\times10^{-5}$ mol, and to the small grain size emulsion in an amount of $7.0\times10^{-5}$ mol, each per mol of the silver halide.

Preparation of Emulsion E for Red-Sensitive Layer

Red-sensitive high sensitivity Emulsion E-1 and low sensitivity Emulsion E-2 were prepared in the same manner as the preparing methods of Emulsions A-1 and A-2 respectively except for lowering the temperature in the grain formation of Emulsion A-1 and changing the kinds of the sensitizing dyes to the following dyes.

Sensitizing Dye G

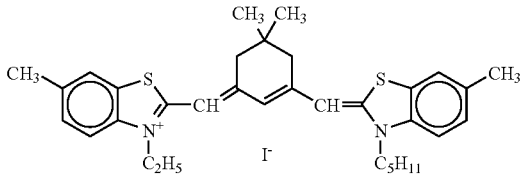

Sensitizing Dye H

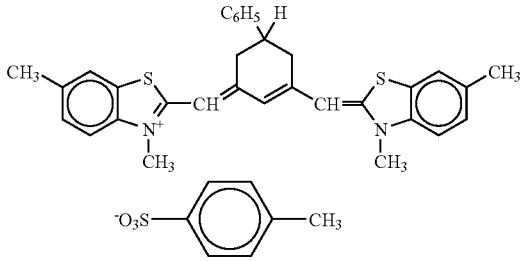

The average side length of the high sensitivity emulsion grains was 0.38 μm, and that of the low sensitivity emulsion grains was 0.32 μm. The variation coefficients of the side length of both emulsions were 9% and 10% respectively.

Sensitizing Dyes G and H were added to the large grain size emulsion in an amount of $8.0\times10^{-5}$ mol, and to the small grain size emulsion in an amount of $10.7\times10^{-5}$ mol, each per mol of the silver halide.

Further, Compound I shown below was added to the red-sensitive emulsion layer in an amount of $3.0\times10^{-3}$ mol per mol of the silver halide.

Compound I

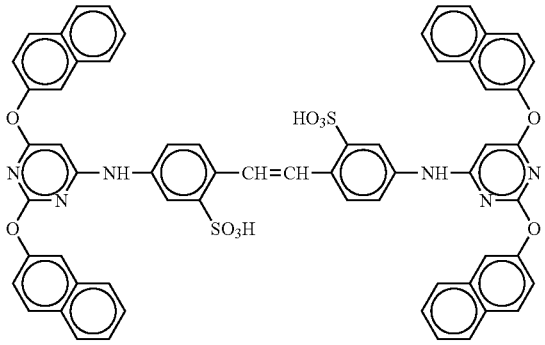

Preparation of Coating Solution for First Layer

A yellow coupler (ExY-1) (57 g), 7 g of a color image stabilizer (Cpd-1), 4 g of a color image stabilizer (Cpd-2), 7 g of a color image stabilizer (Cpd-3), and 2 g of a color image stabilizer (Cpd-8) were dissolved in 21 g of a solvent (Solv-1) and 80 ml of ethyl acetate. This solution was emulsified and dispersed by means of a high velocity stirring emulsifier (dissolver) in 220 g of a 23.5 mass % aqueous gelatin solution containing 4 g of sodium dodecylbenzenesulfonate, and water was added thereto to obtain Emulsified Dispersion A.

On the other hand, the above Emulsified Dispersion A and Emulsions A-1 and A-2 were mixed and dissolved to prepare a coating solution for the first layer having the composition shown below. The coating amount of the emulsion was shown in terms of silver.

The coating solutions for the second to seventh layers 5 were prepared in the same manner as the preparation method of the first layer coating solution. 1-Oxy-3,5-dichloro-s-triazine sodium salt (H-1), (H-2) and (H-3) were used as gelatin hardening agents in each layer. Furthermore, (Ab-1), (Ab-2), (Ab-3) and (Ab-4) were added to each layer in an amount of 15.0 mg/m$^2$, 60.0 mg/m$^2$, 5.0 mg/m$^2$ and 10.0 mg/m$^2$ respectively.

(H-1) Hardening Agent

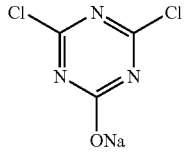

(1.4 mass % per gelatin)

(H-2) Hardening Agent

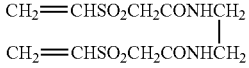

(H-3) Hardening Agent

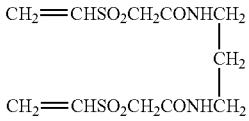

-continued (Ab-1) Antiseptic

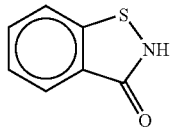

(Ab-2) Antiseptic

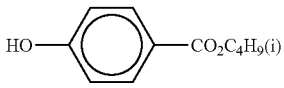

(Ab-3) Antiseptic

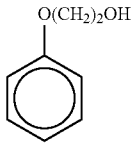

(Ab-4) Antiseptic

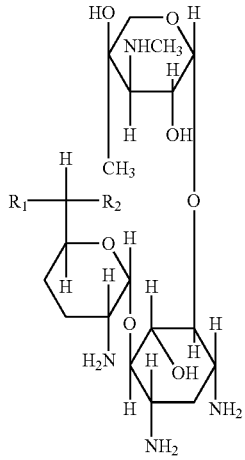

A 1/1/1/1 mixture of a/b/c/d (molar ratio)

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

Further, 1-(3-methylureidophenyl)-5-mercaptotetrazole was added to the second layer, the fourth layer, the sixth layer and the seventh layer in an amount of 0.2 mg/m$^2$, 0.2 mg/m$^2$, 0.6 mg/m$^2$ and 0.1 mg/m$^2$, respectively.

In addition, 4-hydroxy-6-methyl-1,3,3a,7-tetra-azaindene was added to the blue-sensitive emulsion layer and the green-sensitive emulsion layer in an amount of $1\times10^{-4}$ mol and $2\times10^{-4}$ mol, respectively, per mol of the silver halide.

Moreover, 0.05 g/m$^2$ of a copolymer latex of methacrylic acid and butyl acrylate (mass ratio: 1/1, average molecular weight: from 200,000 to 400,000) was added to the red-sensitive emulsion layer.

Further, disodium catechol-3,5-disulfonate was added to the second layer, the fourth layer and the sixth layer in an amount of 6 mg/m$^2$, 6 mg/m$^2$ and 18 mg/m$^2$ respectively.

The following dyes were added for the purpose of irradiation prevention (the numerals in parentheses represent the coating amount).

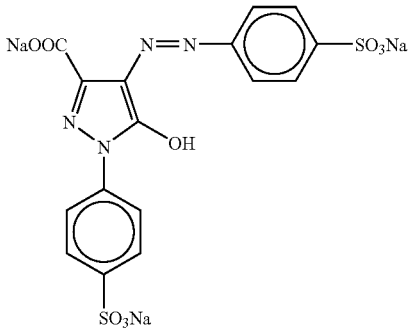

(2mg/m$^2$)

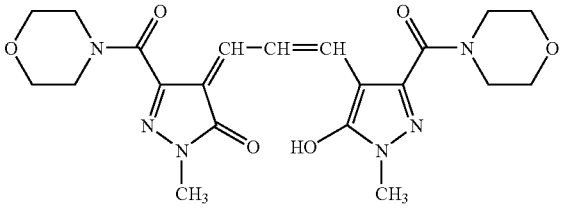

(2mg/m$^2$)

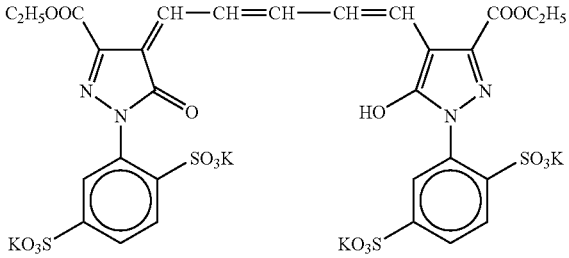

(3mg/m$^2$)

-continued

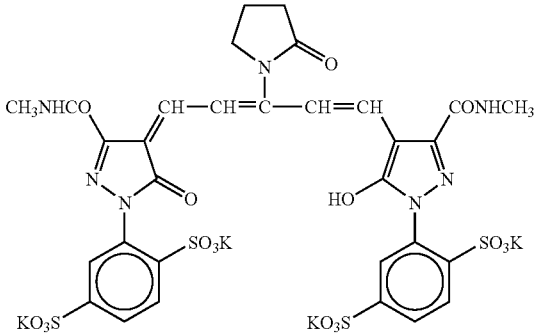

(7mg/m$^2$)

Layer Constitution

The constitution of each layer is described below. The numeral represents the coating amount (g/m$^2$). The numeral for silver halide emulsions represents the coating amount in terms of silver.

Support

Polyethylene resin-laminated paper [a white pigment ($TiO_2$, content: 16 mass %, ZnO, content: 4 mass %), a fluorescent brightening agent (4,4'-bis(5-methylbenzoxazolyl)stilbene, content: 0.03 mass %), and a blue dye (ultramarine, content: 0.33 mass %) were added to the polyethylene resin of the first layer side, and the amount of the polyethylene resin: 29.2 g/m$^2$].

| | |
|---|---|
| First Layer (blue-sensitive emulsion layer) | |
| Silver Chlorobromoiodide Emulsion A (a gold-sulfur-sensitized cubic form emulsion, a 3/7 mixture of large grain size Emulsion A-1/small grain size Emulsion A-2 (silver molar ratio)) | 0.24 |
| Gelatin | 1.25 |
| Yellow Coupler (ExY-1) | 0.56 |
| Yellow Coupler (ExY-2) | 0.56 |
| Color Image Stabilizer (Cpd-1) | 0.07 |
| Color Image Stabilizer (Cpd-2) | 0.04 |
| Color Image Stabilizer (Cpd-3) | 0.07 |
| Color Image Stabilizer (Cpd-8) | 0.02 |
| Solvent (Solv-1) | 0.21 |
| Second Layer (color mixture preventing layer) | |
| Gelatin | 1.15 |
| Color Mixing Preventive (Cpd-4) | 0.10 |
| Color Image Stabilizer (Cpd-5) | 0.018 |
| Color Image Stabilizer (Cpd-6) | 0.13 |
| Color Image Stabilizer (Cpd-7) | 0.07 |
| Solvent (Solv-1) | 0.04 |
| Solvent (Solv-2) | 0.12 |
| Solvent (Solv-5) | 0.11 |
| Third Layer (green-sensitive emulsion layer) | |
| Silver Chlorobromoiodide Emulsion C (a gold-sulfur-sensitized cubic form emulsion, a 1/3 mixture of large grain size Emulsion C-1/small grain size Emulsion C-2 (silver molar ratio)) | 0.14 |
| Gelatin | 0.46 |
| Magenta Coupler (ExM-1) | 0.15 |
| Magenta Coupler (ExM-2) | 0.15 |

-continued

| | |
|---|---|
| Ultraviolet Absorber (UV-A) | 0.14 |
| Color Image Stabilizer (Cpd-2) | 0.003 |
| Color Image Stabilizer (Cpd-4) | 0.002 |
| Color Image Stabilizer (Cpd-6) | 0.09 |
| Color Image Stabilizer (Cpd-8) | 0.02 |
| Color Image Stabilizer (Cpd-9) | 0.01 |
| Color Image Stabilizer (Cpd-10) | 0.01 |
| Color Image Stabilizer (Cpd-11) | 0.0001 |
| Solvent (Solv-3) | 0.09 |
| Solvent (Solv-4) | 0.18 |
| Solvent (Solv-5) | 0 |
| Fourth Layer (color mixture preventing layer) | |
| Gelatin | 0.68 |
| Color Mixing Preventive (Cpd-4) | 0.06 |
| Color Image Stabilizer (Cpd-5) | 0.011 |
| Color Image Stabilizer (Cpd-6) | 0.08 |
| Color Image Stabilizer (Cpd-7) | 0.04 |
| Solvent (Solv-1) | 0.02 |
| Solvent (Solv-2) | 0.07 |
| Solvent (Solv-5) | 0.065 |
| Fifth Layer (red-sensitive emulsion layer) | |
| Silver Chlorobromoiodide Emulsion E (a gold-sulfur-sensitized cubic form emulsion, a 5/5 mixture of large grain size Emulsion E-1/small grain size Emulsion E-2 (silver molar ratio)) | 0.10 |
| Gelatin | 1.11 |
| Cyan Coupler (ExC-1) | 0.02 |
| Cyan Coupler (ExC-3) | 0.01 |
| Cyan Coupler (ExC-4) | 0.11 |
| Cyan Coupler (ExC-5) | 0.01 |
| Color Image Stabilizer (Cpd-1) | 0.01 |
| Color Image Stabilizer (Cpd-6) | 0.06 |
| Color Image Stabilizer (Cpd-7) | 0.02 |
| Color Image Stabilizer (Cpd-9) | 0.04 |
| Color Image Stabilizer (Cpd-10) | 0.01 |
| Color Image Stabilizer (Cpd-14) | 0.01 |
| Color Image Stabilizer (Cpd-15) | 0.12 |
| Color Image Stabilizer (Cpd-16) | 0.01 |
| Color Image Stabilizer (Cpd-17) | 0.01 |
| Color Image Stabilizer (Cpd-18) | 0.07 |
| Color Image Stabilizer (Cpd-20) | 0.01 |
| Ultraviolet Absorber (UV-7) | 0.01 |
| Solvent (Solv-5) | 0.15 |
| Sixth Layer (ultraviolet absorbing layer) | |
| Gelatin | 0.46 |
| Ultraviolet Absorber (UV-B) | 0.35 |
| Compound (S1-4) | 0.0015 |
| Solvent (Solv-7) | 0.18 |
| Seventh Layer (protective layer) | |
| Gelatin | 1.00 |
| Acryl-Modified Copolymer of Polyvinyl Alcohol (modification degree: 17%) | 0.4 |
| Liquid Paraffin | 0.02 |
| Surfactant (Cpd-13) | 0.02 |

(ExY-1) Yellow Coupler

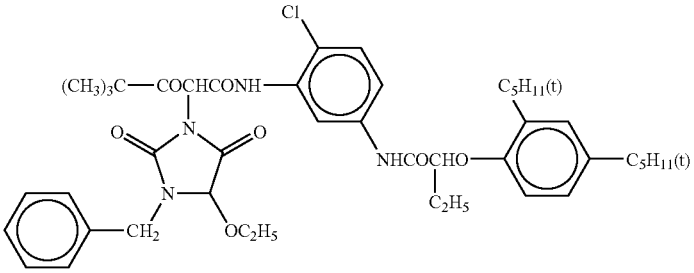

-continued
(ExY-2) Yellow Coupler
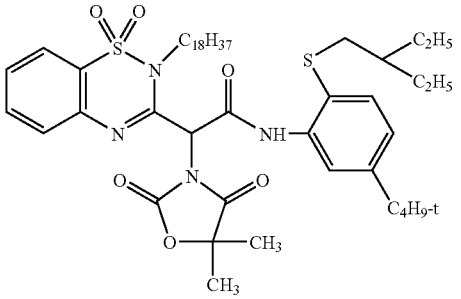
(ExM-1) Magenta Coupler
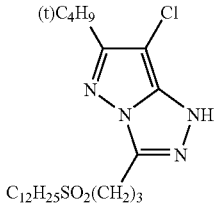
(ExM-2) Magenta Coupler
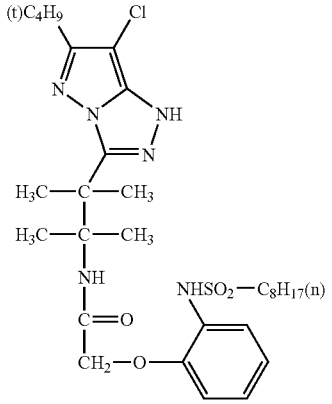
(ExC-1) Cyan Coupler
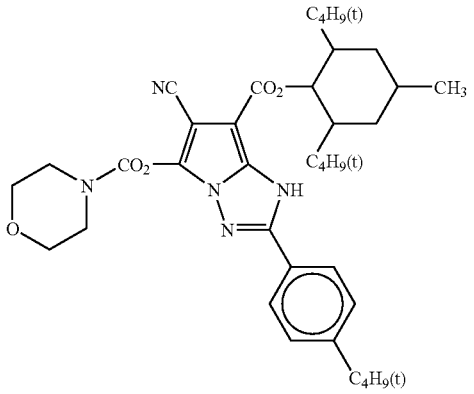
(ExC-2) Cyan Coupler
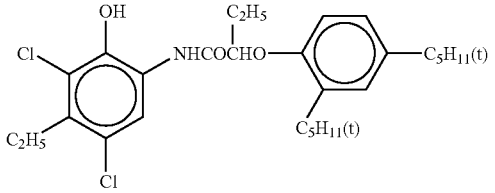

-continued
(ExC-3) Cyan Coupler
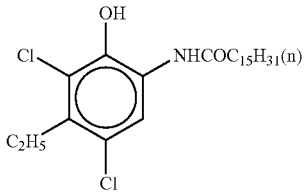
(ExC-4) Cyan Coupler
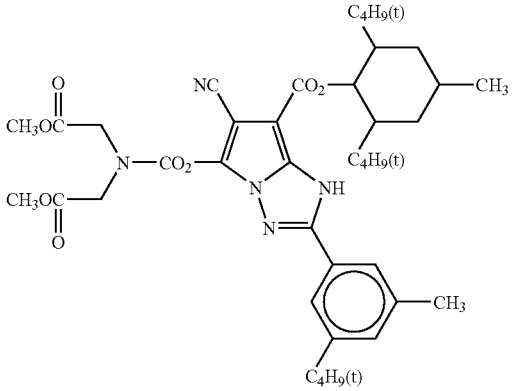
(ExC-5) Cyan Coupler
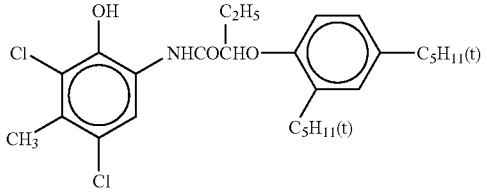
(Cpd-1) Color Image Stabilizer
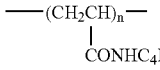
number average molecular weight: 60,000
(Cpd-2) Color Image Stabilizer
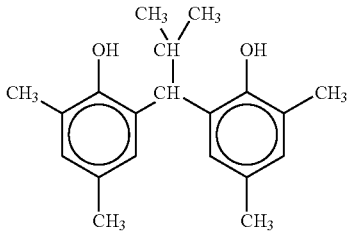
(Cpd-3) Color Image Stabilizer
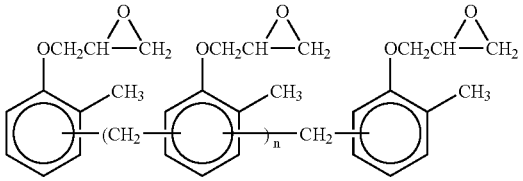
n = 7 to 8 (average value)
(Cpd-4) Color Mixing Preventive
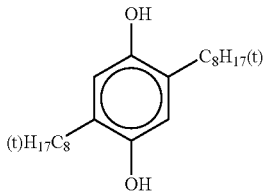

-continued
(Cpd-5) Color Image Stabilizer
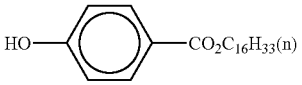
(Cpd-6) Color Image Stabilizer
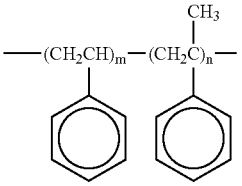
number average molecular weight: 600, m/n = 10/90
(Cpd-7) Color Image Stabilizer
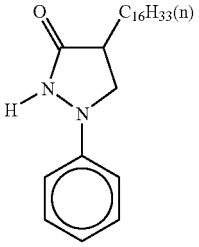
(Cpd-8) Color Image Stabilizer
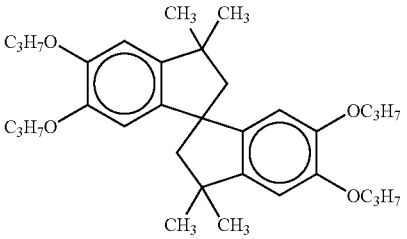
(Cpd-9) Color Image Stabilizer
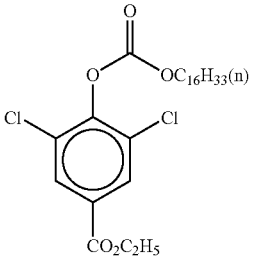
(Cpd-10) Color Image Stabilizer
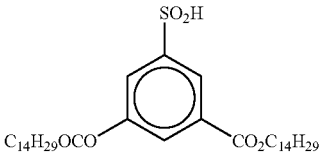

-continued
(Cpd-11) Color Image Stabilizer
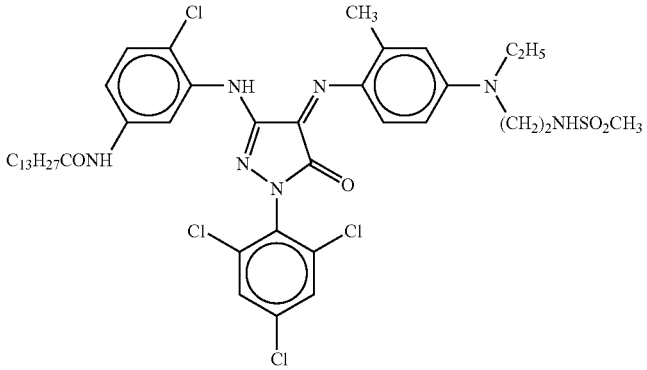
(Cpd-12) Color Image Stabilizer
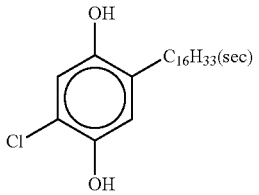
(Cpd-13) Surfactant
A 7/3 mixture by mol ratio of
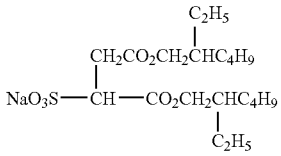
and
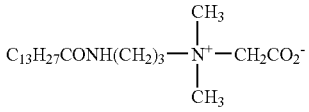
FS-3
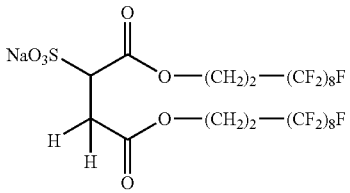
(Cpd-14) Color Image Stabilizer
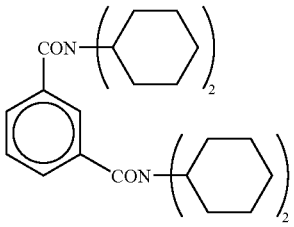
(Cpd-15) Color Image Stabilizer
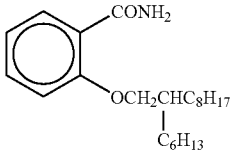

-continued
(Cpd-16) Color Image Stabilizer
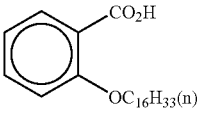
(Cpd-17) Color Image Stabilizer
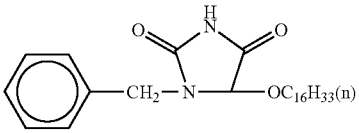
(Cpd-18) Color Image Stabilizer
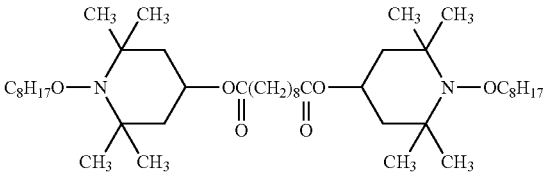
(Cpd-19) Color Mixing Preventive
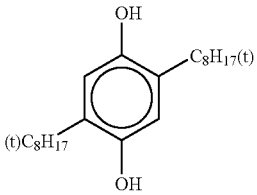
(Cpd-20) Color Image Stabilizer
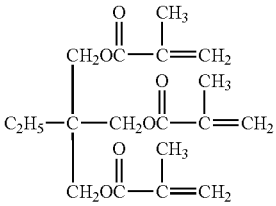
(Solv-1)
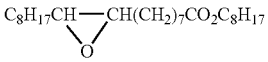
(Solv-2)
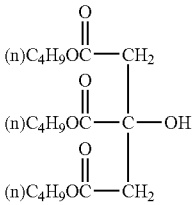
(Solv-3)
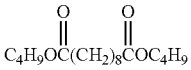
(Solv-4)
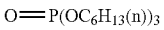
(Solv-5)
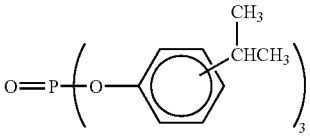

-continued
(Solv-7)
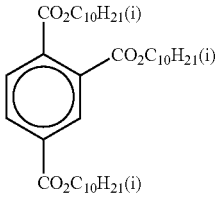
(Solv-8)
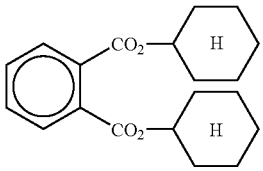
(Solv-9)
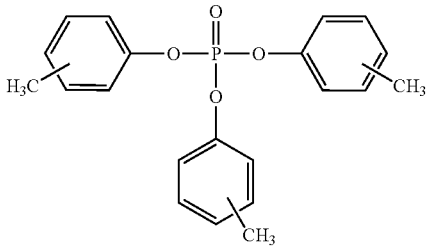
(S1-4)
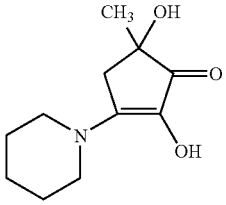
(UV-1) UV Absorber
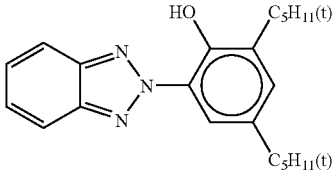
(UV-2) UV Absorber
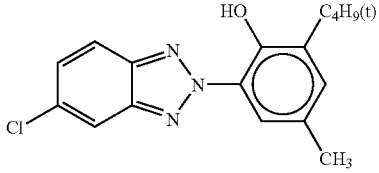
(UV-3) UV Absorber
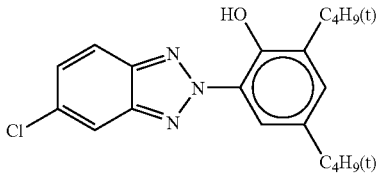

-continued (UV-5) UV Absorber

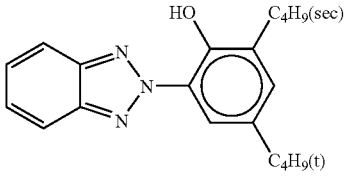

(UV-6) UV Absorber

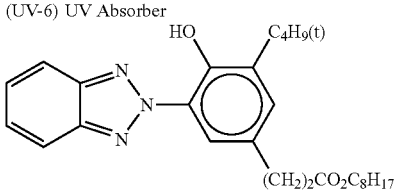

(UV-1) UV Absorber

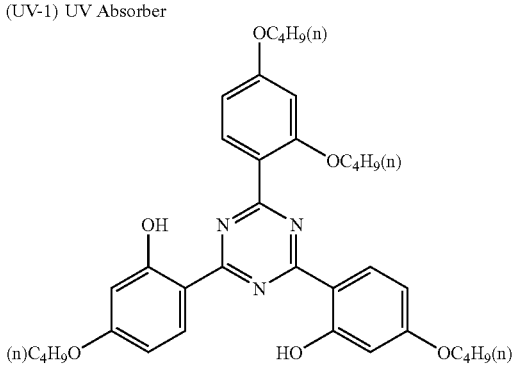

UV-A
A 7/2/2 mixture of UV-1/UV-2/UV-3 (mass ratio)

UV-B
A 13/3/3/5/3 mixture of UV-1/UV-2/UV-3/UV-5/UV-6 (mass ratio)

UV-C
A 9/1 mixture of UV-1/UV-3 (mass ratio)

2. Development Processing

Continuous processing of a photographic sample was performed with a mini-lab printer processor Frontier 330 (manufactured by Fuji Photo Film Co., Ltd.) by the following processing step and processing composition until the color developing replenisher was replenished 3 times the amount of the color developing tank capacity. The conveying velocity of Frontier 330 was increased to 27.9 mm/sec and the processing racks of color development and bleach-fixing tanks were modified. Further, the rinsing tank and the processing rack were modified to the blade conveying system disclosed in JP-A-2002-55422, the liquid-circulating direction was modified to the downward circulating direction (e.g., the system disclosed in Japanese Patent Application No. 2001-147814), and the tank bottom was equipped with a pleated circulating filter.

<Development Processing Condition>

| Processing Step | Processing Temperature (° C.) | Processing Time (sec) | Replenishment Rate* ($ml/m^2$) |
|---|---|---|---|
| Color Development | 45.0 | 25 | 45 |
| Bleach-Fixing | 40.0 | 25 | Agent A: 17.5<br>Agent B: 17.5 |
| Rinsing (1) | 40.0 | 7 | — |
| Rinsing (2) | 40.0 | 4 | — |
| Rinsing (3) | 40.0 | 4 | — |
| Rinsing (4) | 40.0 | 7 | 175 |
| Drying | 80 | 20 | |

<Color Developing Solution>

Replenisher

Each of the color developer replenishers #1 to #5 stored at 5° C. in an airtight vinyl chloride resin bottle and the above elapsed color developer replenisher were used.

Tank Solution

The developing tank solution was prepared by mixing 300 ml of each developer replenisher, 100 ml of CP-47L-P1-S solution (manufactured by Fuji Photo Film Co., Ltd.) and 600 ml of water.

Bleach-Fixing Solution

| | Tank Replenisher | Replenisher | |
|---|---|---|---|
| | Solution | A | B |
| Water | 600 ml | 300 ml | 300 ml |
| Ammonium thiosulfate ml (750 g/liter) | 97.0 ml | — | 376.0 |
| Ammonium bisulfite (65%) ml | 13.0 g | — | 185.5 |
| Ammonium sulfite | 21.0 g | — | — |
| Ammonium ethylenediaminetetra-acetato ferrate (III) | 37.0 g | 184.0 g | — |
| Ethylenediaminetetraacetic acid | 10.0 g | 1.6 g | 0.4 g |
| m-Carboxysulfinic acid | 3.0 g | 14.0 g | — |
| Nitric acid | 5.2 g | 25.0 g | — |
| Succinic acid | 6.7 g | 33.0 g | — |
| Imidazole | 1.3 g | — | — |
| Aqueous ammonia (27%) | 3.4 g | — | 36.0 g |
| Water to make | 1,000 ml | 1,000 ml | 1,000 ml |
| pH (adjusted with ammonia and nitric acid at 25° C.) | 5.9 | 2.5 | 5.75 |

-continued

Rinsing Solution

The tank solution is equal to the replenisher.

| | |
|---|---|
| Sodium chlorinated isocyanurate | 0.02 g |
| Deionized water (electric conductivity: 1,000 ml 5 μs/cm or less) | |

The bleach-fixing solution was used by diluting Part A and Part B of the bleach-fixing concentrated composition with water by 1.5 times.

Results

Evaluating Methods of Results

The sensitivities of the green-sensitive layers (the reciprocal logarithmic value of the exposure amount giving Dmin+0.1) of the photographic samples respectively obtained by processing with the replenisher preserved in the simulated replenisher tank at room temperature for two weeks and with the replenisher preserved in a refrigerator were compared. From the comparison, the sensitivity difference (desensitized rate) in the case of being processed with the solution having open area and after the lapse of two weeks, i.e., the desensitization degree in the magenta density region (desensitization of M density), was found and this was taken as the criterion of desensitization.

Examination of Results

The results obtained are shown in Table 2 below. It is shown in the results that desensitization is markedly improved in the concentrated composition samples #4 and #5 having the constitution of the present invention.

TABLE 2

| | #1 | #2 | #3 | #4 | #5 |
|---|---|---|---|---|---|
| Precipitation of concentrated solution | None | Generated slightly | Generated slightly | None | None |
| Precipitates around the floating lid on the replenisher | Generated in a small amount | Generated in a large amount (liquid surface was covered entirely) | Generated in a large amount (liquid surface was covered entirely) | Not generated | Not generated |
| Desensitization of M density | 0.04 | 0.06 | 0.06 | 0.02 | 0.02 |
| | Comparison | Comparison | Comparison | Invention | Invention |

Example 2

Developer replenisher concentrated solutions #11 to #15 were prepared in the same manner as in Example 1 except that the exemplified Compound II-13 of the fluorescent brightening agent represented by formula (II) was added in an amount of 5 g/liter to every developer replenisher concentrated solutions #1 to #5, and the same photographic evaluation tests as in Example 1 were performed.

The results obtained are shown in Table 3 below.

TABLE 3

| | #11 | #12 | #13 | #14 | #15 |
|---|---|---|---|---|---|
| Precipitation of concentrated solution | Generated slightly | Generated | Generated | None | None |

TABLE 3-continued

| | #11 | #12 | #13 | #14 | #15 |
|---|---|---|---|---|---|
| Precipitates around the floating lid on the replenisher | Generated in a large amount (liquid surface was covered entirely) | Generated in a large amount (liquid surface was covered entirely) | Generated in a large amount (liquid surface was covered entirely) | Not generated | Not generated |
| Desensitization of M density | 0.06 | 0.08 | 0.08 | 0.02 | 0.02 |
| | Comparison | Comparison | Comparison | Invention | Invention |

In Table 3, desensitization was slight in developer replenisher concentrated solutions #14 and #15 having the constitution of the present invention similarly to the results in Example 1, on the other hand, desensitization increased by the addition of the fluorescent brightening agent in the comparative samples.

The concentrated composition of a color developer replenisher possessing the requisites of the composition to the constitution of the present invention comprises one-part constitution, does not generate precipitates even when stored at low temperature, has the degree of concentration capable of rapid development and low replenishing development, is practicable in cost, and is not accompanied by a phenomenon of creeping up. Moreover, an automatic processor can be used for the process using this processing composition at a low replenishing rate and rapidly.

This application is based on Japanese Patent application JP 2002-212674, filed Jul. 22, 2002, the entire content of which is hereby incorporated by reference, the same as if set forth at length.

What is claimed is:

1. A concentrated composition of a color developer replenisher for a silver halide color photographic material, the composition comprising a single solution, wherein the solution comprises 0.14 mol/liter or more of a p-phenylenediamine color developing agent, the solution has a specific gravity of 1.2 or more, the solution has pH of 13.3 or more, the solution comprises from 0.2 to 1 mol/liter of at least one compound selected from benzenesulfonic acids which are optionally substituted with an alkyl group, and lactams, and the solution comprises substantially no alkanolamine.

2. The composition according to claim 1, which further comprises a benzenesulfinic acid compound.

3. The composition according to claim 2, wherein the benzenesulfinic acid compound is a carboxybenzenesulfinic acid.

4. The composition according to claim 1, wherein the solution comprises from 0.15 to 0.20 mol/liter of the p-phenylenediamine color developing agent.

5. The composition according to claim 1, wherein the solution has a specific gravity of from 1.2 to 1.3.

6. The composition according to claim 1, wherein the solution has pH of from 13.3 to 13.5.

7. The composition according to claim 1, wherein the solution comprises from 0.25 to 0.5 mol/liter of at least one compound selected from benzenesulfonic acids which are optionally substituted with an alkyl group, and lactams.

8. The composition according to claim 1, wherein the solution comprises 3 g/liter or less of alkanolamine.

9. The composition according to claim 1, which further comprises a fluorescent brightening agent.

10. The composition according to claim 9, wherein the fluorescent brightening agent is a 4,4'-bis[3-(sulfoanilino)-s-triazinylamino]stilbene derivative.

11. The method for processing a silver halide color photographic material which comprises:

color developing an exposed silver halide color photographic material with a color developing solution and a color developer replenisher prepared by diluting the concentration of the composition according to claim 1 three to six times with water, wherein a temperature of the color developing solution is from 43 to 60° C., color developing time is 27 seconds or less, and a transfer speed of the photographic material in the color developing solution is a linear velocity of 27.8 mm/sec or more.

12. The method according to claim 11, wherein a replenisher amount of the replenisher is 50 ml or less per $m^2$ of the photographic material.

13. The method according to claim 11, wherein the replenisher further comprises a benzenesulfinic acid compound.

14. The method according to claim 11, wherein the replenisher further comprises a carboxybenzenesulfinic acid.

15. The method according to claim 11, wherein the replenisher further comprises a fluorescent brightening agent.

16. The method according to claim 11, wherein the silver halide color photographic material is a color paper.

17. A method for preparing a color developer replenisher, comprising diluting the concentration of the composition according to claim 1 three to six times with water.

18. The method for preparing a color developer replenisher according to claim 17, wherein the color developer replenisher comprises from 2 to 200 mmol of the color developing agent per liter of the developer replenisher.

* * * * *